US008859669B2

(12) United States Patent
Sugasaki

(10) Patent No.: US 8,859,669 B2
(45) Date of Patent: Oct. 14, 2014

(54) PROCESS FOR PRODUCING RELIEF PRINTING PLATE PRECURSOR FOR LASER ENGRAVING, RELIEF PRINTING PLATE PRECURSOR FOR LASER ENGRAVING, PROCESS FOR MAKING RELIEF PRINTING PLATE, AND RELIEF PRINTING PLATE

(75) Inventor: Atsushi Sugasaki, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 288 days.

(21) Appl. No.: 13/411,137

(22) Filed: Mar. 2, 2012

(65) Prior Publication Data

US 2012/0225256 A1 Sep. 6, 2012

(30) Foreign Application Priority Data

Mar. 4, 2011 (JP) ..... 2011-048128

(51) Int. Cl.
*B41C 1/05* (2006.01)
*B41N 1/22* (2006.01)

(52) U.S. Cl.
CPC .... *B41C 1/05* (2013.01); *B41N 1/22* (2013.01)
USPC ..... 524/495

(58) Field of Classification Search
CPC ..... B41N 1/05; B41N 1/02; B41C 1/05; B41C 1/052
USPC ..... 524/495
See application file for complete search history.

(56) References Cited

U.S. PATENT DOCUMENTS

2011/0048261 A1* 3/2011 Shimura ..... 101/395

FOREIGN PATENT DOCUMENTS

| | | | |
|---|---|---|---|
| JP | 2009-190331 A | | 8/2009 |
| JP | 2010-106070 A | | 5/2010 |
| WO | WO2009/102035 | * | 8/2009 |

* cited by examiner

*Primary Examiner* — Edward Cain
(74) *Attorney, Agent, or Firm* — Sughrue Mion, PLLC

(57) ABSTRACT

A process for producing a relief printing plate precursor for laser engraving is provided that comprises a layer forming step of forming a relief-forming layer formed from a resin composition for laser engraving containing (Component A) an isocyanate compound having an average number of isocyanato groups, fn, of greater than 2, and (Component B) a compound having a siloxane bond in the molecule and having two or more active hydrogen atoms; and a crosslinking step of thermally crosslinking the relief-forming layer, and thereby obtaining a relief printing plate precursor having a crosslinked relief-forming layer. Furthermore, there are also provided a relief printing plate obtained by the above process, a process for making a relief printing plate, and a relief printing plate.

14 Claims, No Drawings

PROCESS FOR PRODUCING RELIEF PRINTING PLATE PRECURSOR FOR LASER ENGRAVING, RELIEF PRINTING PLATE PRECURSOR FOR LASER ENGRAVING, PROCESS FOR MAKING RELIEF PRINTING PLATE, AND RELIEF PRINTING PLATE

TECHNICAL FIELD

The present invention relates to a process for producing a relief printing plate precursor for laser engraving, a relief printing plate precursor for laser engraving, a process for making a relief printing plate, and a relief printing plate.

BACKGROUND ART

A large number of so-called "direct engraving CTP methods", in which a relief-forming layer is directly engraved by means of a laser are proposed. In the method, a laser light is directly irradiated to a flexographic printing plate precursor to cause thermal decomposition and volatilization by photothermal conversion, thereby forming a concave part. Differing from a relief formation using an original image film, the direct engraving CTP method can control freely relief shapes. Consequently, when such image as an outline character is to be formed, it is also possible to engrave that region deeper than other regions, or, in the case of a fine halftone dot image, it is possible, taking into consideration resistance to printing pressure, to engrave while adding a shoulder. With regard to the laser for use in the method, a high-power carbon dioxide laser is generally used. In the case of the carbon dioxide laser, all organic compounds can absorb the irradiation energy and convert it into heat. On the other hand, inexpensive and small-sized semiconductor lasers have been developed, wherein, since they emit visible lights and near infrared lights, it is necessary to absorb the laser light and convert it into heat.

As a resin composition for laser engraving, those described in JP-A-2009-190331 (JP-A denotes a Japanese unexamined patent application publication) or JP-A-2010-106070 are known.

SUMMARY OF THE INVENTION

It is an object of the present invention to provide a relief printing plate precursor having excellent rinsing properties and excellent engraving sensitivity, and a process for producing the relief printing plate precursor. Another object is to provide a relief printing plate having excellent suitability to solvent inks and having excellent printing durability, and a process for making the relief printing plate.

The problems of the present invention described above have been solved by the following means <1>, <13>, <14> and <15>. Preferred embodiments <2> to <12>, <16> and <17> will also be described below.

<1> A process for producing a relief printing plate precursor for laser engraving, the process comprising a layer forming step of forming a relief-forming layer formed from a resin composition for laser engraving containing (Component A) an isocyanate compound having an average number of isocyanato groups, fn, of greater than 2, and (Component B) a compound having a siloxane bond in the molecule and having two or more active hydrogen atoms; and a crosslinking step of thermally crosslinking the relief-forming layer, and thereby obtaining a relief printing plate precursor having a crosslinked relief-forming layer;

<2> the process for producing a relief printing plate precursor for laser engraving according to <1>, wherein the resin composition for laser engraving further comprises (Component C) a compound which does not contain a siloxane bond in the molecule but has two or more active hydrogen atoms;

<3> the process for producing a relief printing plate precursor for laser engraving according to <1> or <2>, wherein the resin composition for laser engraving further comprises (Component D) a radical polymerizable compound, and (Component E) a radical polymerization initiator;

<4> the process for producing a relief printing plate precursor for laser engraving according to any one of <1> to <3>, wherein the resin composition for laser engraving further comprises (Component F) a photothermal conversion agent capable of absorbing light having a wavelength of 700 nm to 1,300 nm;

<5> the process for producing a relief printing plate precursor for laser engraving according to any one of <1> to <4>, wherein the resin composition for laser engraving further comprises (Component G) a plasticizer;

<6> the process for producing a relief printing plate precursor for laser engraving according to any one of <1> to <5>, wherein the resin composition for laser engraving further comprises (Component H) a compound having a hydrolyzable silyl group and/or a silanol group;

<7> the process for producing a relief printing plate precursor for laser engraving according to any one of <1> to <6>, wherein the average number of isocyanato groups, fn, of Component A is 2.2 to 3.8;

<8> the process for producing a relief printing plate precursor for laser engraving according to any one of <1> to <7>, wherein Component B is a both terminal-modified silicone oil and/or a single terminal-modified silicone oil;

<9> the process for producing a relief printing plate precursor for laser engraving according to any one of <1> to <8>, wherein Component B is selected from the group consisting of a both terminal carbinol-modified silicone oil, a both terminal amino-modified silicone oil, and a single terminal diol-modified silicone oil;

<10> the process for producing a relief printing plate precursor for laser engraving according to any one of <3> to <9>, wherein Component D is a polyfunctional ethylenically unsaturated compound;

<11> the process for producing a relief printing plate precursor for laser engraving according to any one of <3> to <10>, wherein Component E is an organic peroxide;

<12> the process for producing a relief printing plate precursor for laser engraving according to any one of <4> to <11>, wherein Component F is carbon black;

<13> a relief printing plate precursor for laser engraving, obtained by the process according to any one of <1> to <12>;

<14> a process for making a relief printing plate, the process comprising an engraving step of laser-engraving the relief printing plate precursor according to <13>, and thereby forming a relief layer;

<15> a relief printing plate comprising a relief layer, produced by the process according to <14>;

<16> the relief printing plate according to <15>, wherein the thickness of the relief layer is 0.05 mm to 10 mm; and <17> the relief printing plate according to <15> or <16>, wherein the Shore A hardness of the relief layer is 50° to 90°.

DESCRIPTION OF EMBODIMENTS

Process for Producing Relief Printing Plate Precursor for Laser Engraving

The process for producing a relief printing plate precursor for laser engraving (hereinafter, also simply referred to as relief printing plate precursor) of the present invention comprises a layer forming step of forming a relief-forming layer formed from a resin composition for laser engraving containing (Component A) an isocyanate compound having an average number of isocyanato groups, fn, of greater than 2, and (Component B) a compound having a siloxane bond in the molecule and having two or more active hydrogen atoms; and a crosslinking step of thermally crosslinking the relief-forming layer, and thereby obtaining a relief printing plate precursor having a crosslinked relief-forming layer.

In the present invention, the notation 'lower limit to upper limit', which expresses a numerical range, means 'at least the lower limit but no greater than the upper limit', and the notation 'upper limit to lower limit' means 'no greater than the upper limit but at least the lower limit'. That is, they are numerical ranges that include the upper limit and the lower limit. "(Component A) an isocyanate compound having an average number of isocyanato groups, fn, of greater than 2" etc. are simply called "Component A" etc.

Furthermore a resin composition for laser engraving comprising Component A and Component B is also called "a resin composition for laser engraving of the present invention" or "a resin composition of the present invention.

There has been a problem that when the resins for laser engraving described in JP-A-2009-190331 or JP-A-2010-106070 are used, the rinsing properties and ink transferability (suitability to solvent inks) are inadequate.

This time, the inventors of the present invention conducted a thorough investigation, and as a result, the inventors found that when Component A and Component B are incorporated into a resin composition for laser engraving without polymerizing the components in advance, and crosslinking is carried out simultaneously while the reaction between Component A and Component B is carried out in the crosslinking step, the suitability to solvent inks is enhanced as compared with the conventional cases of using a resin that has been polymerized in advance. Also, a good balance is achieved between the water resistance of the resulting relief printing plate and favorable rinsing properties, and a printing plate precursor for laser engraving having excellent engraving sensitivity is obtained.

Furthermore, according to the present invention, in regard to the resin composition for laser engraving comprising Component A and Component B, the occurrence of a polymerization reaction before the layer forming step need not be excluded, but it is desirable that at least portions of Component A and Component B remain unreacted without being polymerized.

When the total amount of Component A added to the resin composition for laser engraving is designated as 100 wt %, it is preferable that 50 wt % or more, more preferably 70 wt % or more, and even more preferably 90 wt % or more, of Component A exist in its original state (the state as Component A) immediately before the layer forming step.

Also, when the total amount of Component B added to the resin composition for laser engraving is designated as 100 wt %, it is preferable that 50 wt % or more, more preferably 70 wt % or more, and even more preferably 90 wt % or more, of Component B exist in its original state (the state as Component B) immediately before the layer forming step.

Furthermore, in the drying process and the like in the layer forming step, and in the crosslinking step, it is preferable that the polymerization reaction proceed. When the total amount of Component A added to the resin composition for laser engraving is designated as 100 wt %, it is preferable that the proportion of Component A that exists in its original state (the state as component A) after the crosslinking step be 50 wt % or less, more preferably 30 wt % or less, and even more preferably 10 wt % or less, and it is most preferable that no Component A exist after the crosslinking step. Furthermore, when the total amount of Component B added to the resin composition for laser engraving is designated as 100 wt %, it is preferable that the proportion of Component B that exists in its original state (the state as component B) after the crosslinking step be 50 wt % or less, more preferably 30 wt % or less, and even more preferably 10 wt % or less, and it is most preferable that no Component B exist after the crosslinking step.

When Component A and Component B exist in the amounts described above, it is preferable because a relief printing plate precursor having excellent rinsing properties, and a relief printing plate having excellent suitability to solvent inks and excellent printing durability can be obtained.

In the present specification, when a relief printing plate precursor is explained, a layer that comprises Component A and Component B, that serves as an image-forming layer subjected to laser engraving, that has a flat surface, and that is an uncrosslinked crosslinkable layer is called a relief-forming layer, a layer that is formed by crosslinking the relief-forming layer is called a crosslinked relief-forming layer, and a layer that has asperities formed on the surface by laser engraving the crosslinked relief-forming layer is called a relief layer.

Constituent components of the resin composition for laser engraving of the present invention are explained below.

(Component A) Isocyanate Compound Having Average Number of Isocyanato Groups, fn, of Greater than 2

The resin composition for laser engraving of the present invention comprises (Component A) an isocyanate compound having an average number of isocyanato groups, fn, of greater than 2.

The average number of isocyanato groups, fn, of Component A is not particularly limited if it is greater than 2, but the average number is preferably greater than 2 and equal to or less than 4, more preferably 2.2 to 3.8, and even more preferably 2.4 to 3.6. If the average number of isocyanato groups, fn, is equal to or less than 2, the crosslinking density is insufficient. As long as the average number of isocyanato groups, fn, is in the range described above, the isocyanate compound may be a single isocyanate compound, or may include any unreacted isocyanate compound that is produced as a side product at the time of the production of the isocyanate compound. The average number of isocyanato groups, fn, can be determined by the following formula:

$$\text{Average number of isocyanato groups} = (\text{Number average molecular weight}) \times (\text{Isocyanato group wt \%}) / (\text{Formula weight of isocyanato}(42) \times 100)$$

Component A used in the present invention preferably includes at least one chemical structure selected from the group consisting of isocyanurate, uretdione, allophanate, and biuret.

Examples of Component A having an isocyanurate structure include an isocyanurate trimer, and an isocyanurate pentamer, and oligomers such as an isocyanurate heptamer, a nonamer and higher oligomers are also available.

An isocyanurate trimer is a polyisocyanate having isocyanurate groups, which is formed from three molecules of a diisocyanate monomer, and the isocyanurate trimer is represented by Formula (2) below.

(2)

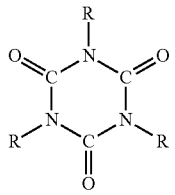

In Formula (2), R denotes a diisocyanate monomer residue.

An isocyanurate pentamer is a polyisocyanate having an isocyanurate structure, which is formed from six molecules of a diisocyanate monomer, and the isocyanurate pentamer is represented by Formula (3) below.

(3)

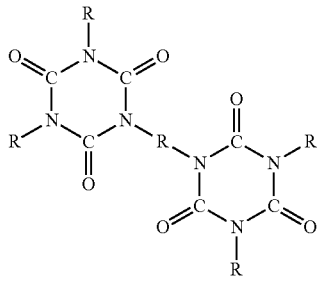

In Formula (3), R denotes a diisocyanate monomer residue.

A compound having an allophanate structure is formed from a hydroxyl group of a monoalcohol and an isocyanato group, and is represented by Formula (4) below.

(4)

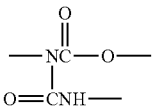

An example of a compound having a uretdione structure may be a uretdione dimer. A uretdione dimer is a compound having a uretdione group, which is formed from two molecules of a diisocyanate monomer, and the uretdione dimer is represented by Formula (5) below.

(5)

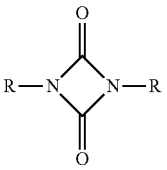

In Formula (5), R denotes a diisocyanate monomer residue.

A compound having a biuret structure is formed from an urea and an isocyanato group, and is represented by Formula (6) below.

(6)

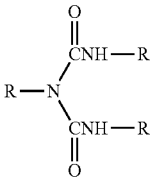

In Formula (6), R denotes a diisocyanate monomer residue.

As Component A, a conventionally known isocyanate compound having an average number of isocyanato groups, fn, of greater than 2 can be used. Also, Component A can also be produced by using various isocyanate compounds as raw materials. As the isocyanate compounds that may be used as raw materials, diisocyanate compounds or other polyisocyanate compounds can be used. Examples of the diisocyanate compounds that can be used include an aliphatic diisocyanate compound, an alicyclic diisocyanate compound, an aromatic-aliphatic diisocyanate compound, and an aromatic diisocyanate compound.

The aliphatic diisocyanate compound that is used as a raw material for Component A is not particularly limited, and examples thereof include 1,3-trimethylene diisocyanate, 1,4-tetramethylene diisocyanate, 1,3-pentamethylene diisocyanate, 1,5-pentamethylene diisocyanate, 1,6-hexamethylene diisocyanate, 1,2-propylene diisocyanate, 1,2-butylene diisocyanate, 2,3-butylene diisocyanate, 1,3-butylene diisocyanate, 2-methyl-1,5-pentamethylene diisocyanate, 3-methyl-1,5-pentamethylene diisocyanate, 2,4,4-trimethyl-1,6-hexamethylene diisocyanate, 2,2,4-trimethyl-1,6-hexamethylene diisocyanate, 2,6-diisocyanatomethyl caproate, and lysine diisocyanate.

The alicyclic diisocyanate compound that is used as a raw material for Component A is not particularly limited, and examples thereof include 1,3-cyclopentane diisocyanate, 1,4-cyclohexane diisocyanate, 1,3-cyclohexane diisocyanate, 3-isocyanatomethyl-3,5,5-trimethylcyclohexyl isocyanate, 4,4'-methylenebis(cyclohexyl isocyanate), methyl-2,4-cyclohexane diisocyanate, methyl-2,6-cyclohexane diisocyanate, 1,3-bis(isocyanatomethyl)cyclohexane, 1,4-bis(isocyanatomethyl)cyclohexane, isophorone diisocyanate, and norbornane diisocyanate.

The aromatic-aliphatic diisocyanate compound that is used as a raw material for Component A is not particularly limited, and examples thereof include 1,3-xylylene diisocyanate, 1,4-xylylene diisocyanate, ω,ω'-diisocyanato-1,4-diethylbenzene, 1,3-bis(1-isocyanato-1-methylethyl)benzene, 1,4-bis(1-isocyanato-1-methylethyl)benzene, and 1,3-bis(α,α-dimethylisocyanatomethyl)benzene.

The aromatic diisocyanate compound that is used as a raw material for Component A is not particularly limited, and examples thereof include m-phenylene diisocyanate, p-phenylene diisocyanate, 2,4-tolylene diisocyanate, 2,6-tolylene diisocyanate, naphthalene-1,4-diisocyanate, 1,5-naphthalene diisocyanate, 4,4'-diphenyl diisocyanate, 4,4'-diphenylmethane diisocyanate, 2,4'-diphenylmethane diisocyanate, 4,4'-diphenyl ether diisocyanate, 2-nitrodiphenyl-4,4'-diisocyanate, 2,2'-diphenylpropane-4,4'-diisocyanate, 3,3'-dimethyldiphenylmethane-4,4'-diisocyanate, 4,4'-diphenylpropane diisocyanate, and 3,3'-dimethoxydiphenyl-4,4'-diisocyanate.

The isocyanate compounds exemplified above as the raw material isocyanate for Component A can be used individually or in combination.

Preferred examples of the raw material isocyanate compound for Component A include tolylene diisocyanate (hereinafter, abbreviated to TDI), diphenylmethane diisocyanate (hereinafter, abbreviated to MDI), hexamethylene diisocyanate (hereinafter, abbreviated to HDI), isophorone diisocyanate (hereinafter, abbreviated to IPDI), diphenylmethane diisocyanate including a diphenylmethane diisocyanate dimer compound, carbodiimide-modified diphenylmethane diisocyanate, and uretdione ring- and isocyanurate ring-containing modification products of hexamethylene diisocyanate, and these can be used individually or in combination. From the viewpoint of weather resistance, HDI or IPDI is more preferable, and from the viewpoint of mechanical characteristics, MDI or TDI is more preferable. Furthermore, from the viewpoint of the abundance of the types of isocyanate, HDI is even more preferable.

Examples of Component A that is produced from the isocyanate compounds that are used as raw materials include isocyanurate ring-containing modification products, uretdione ring-containing modification products, allophanate-containing modification products, and biuret-containing modification products of hexamethylene diisocyanate. These can be used individually or in combination. From the viewpoint of solvent resistance, isocyanurate ring-containing modification products are preferable.

As Component A, commercially available products can also be employed, and examples include Duranate TPA-100, Duranate TKA-100, Duranate TLA-100, Duranate TSA-100, Duranate TSE-100, Duranate TSS-100, Duranate TSR-100, and Duranate 24A-100 (all manufactured by Asahi Chemical Corp.).

The content of Component A in the resin composition is preferably 5 wt % to 80 wt %, more preferably 15 wt % to 60 wt %, and even more preferably 20 wt % to 50 wt %, relative to the total amount of solid components excluding volatile components.

When the content of Component A is in the range described above, it is preferable because excellent ink transferability can be obtained.

(Component B) Compound Having Siloxane Bond in Molecule and Having Two or More Active Hydrogen Atoms The resin composition of the present invention comprises (Component B) a compound having a siloxane compound in the molecule and having two or more active hydrogen atoms.

Meanwhile, an active hydrogen atom means hydrogen atoms in —OH, —SH, —NH—, —$NH_2$, —COOH and the like, and means a hydrogen atoms having reactivity with the isocyanato group of Component A. Among these, the active hydrogen atom is preferably a hydrogen atom in —OH, —NH— or —$NH_2$.

Component B is such that the upper limit of the number of active hydrogen atoms is not particularly limited as long as it has two or more active hydrogen atoms in one molecule, but the number of active hydrogen atoms is preferably 2 to 6, more preferably 2 to 4, even more preferably 2 to 3, and particularly preferably 2. If the number of active hydrogen atoms of Component B in one molecule is less than 2, Component B cannot sufficiently react with Component A. If the number of active hydrogen atoms in one molecule of Component B is 6 or less, it is preferable because the resulting printing plate precursor has excellent rinsing properties.

It is necessary for Component B to have a siloxane bond in the molecule.

<Siloxane Bond>

The siloxane bond will be explained. A siloxane bond means a molecular structure in which silicon (Si) and oxygen (O) are alternately bonded.

The details of the mechanism by which the relief printing plate obtained by using the resin composition of the present invention has excellent suitability to solvent inks is not clearly known, but the inventors speculate that it is due to the siloxane bonds that are stably bonded in Component B, Component B has lower affinity to ink as compared with the case where the compounds added as additives have siloxane bonds, and therefore, the suitability to solvent inks is enhanced.

It is preferable that Component B be obtained from a silicone compound represented by following average composition Formula (1).

$$R_pQ_rX_sSiO_{(4-p-r-s)/2} \quad (1)$$

In Formula (1), R represents one kind or two or more kinds of hydrocarbon groups selected from the group consisting of a linear or branched alkyl group having 1 to 30 carbon atoms, a cycloalkyl group having 5 to 20 carbon atoms, an alkyl group having 1 to 30 carbon atoms (number of carbon atoms before substitution) substituted with an alkoxy group having 1 to 20 carbon atoms or an aryl group having 6 to 20 carbon atoms, an aryl group having 6 to 20 carbon atoms substituted with a halogen atom, an alkoxycarbonyl group having 2 to 30 carbon atoms, a monovalent group containing a carboxyl group or a salt thereof, a monovalent group containing a sulfo group or a salt thereof, and a polyoxyalkylene group; Q and X each represent one kind or two or more kinds of hydrocarbon groups selected from the group consisting of a hydrogen atom, a linear or branched alkyl group having 1 to 30 carbon atoms, a cycloalkyl group having 5 to 20 carbon atoms, an alkyl group having 1 to 30 carbon atoms substituted with an alkoxy group having 1 to 20 carbon atoms or an aryl group having 6 to 20 carbon atoms, an aryl group having 6 to 20 carbon atoms substituted with a halogen atom, an alkoxycarbonyl group having 2 to 30 carbon atoms, a monovalent group containing a carboxyl group or a salt thereof, a monovalent group containing a sulfo group or a salt thereof, and a polyoxyalkylene group; and p, r and s represent numbers that satisfy the relations: $0<p<4$, $0\leq r<4$, $0\leq s<4$, and $(p+r+s)<4$.

According to the exemplary embodiment of the present invention, Component B can be obtained from a compound having a siloxane bond, which is intended to introduce a siloxane bond.

An example of the compound having a siloxane bond, which is intended to introduce a siloxane bond, may be silicone oils. Examples of silicone oils include low-viscosity to high-viscosity organopolysiloxanes such as dimethylpolysiloxane, methylphenyl polysiloxane, methyl hydrogen polysiloxane, and dimethylsiloxane-methylphenylsiloxane copolymers; cyclic siloxanes such as octamethylcyclotetrasiloxane, decamethylcyclopentasiloxane, dodecamethylcyclohexasiloxane, tetramethyltetrahydrogen cyclotetrasiloxane, and tetramethyltetraphenyl cyclotetrasiloxane; silicone rubbers such as gum-like dimethylpolysiloxane having a high degree of polymerization, and gum-like dimethylsiloxane-methylphenylsiloxane copolymers; and cyclic siloxane solutions of silicone rubbers, trimethylsiloxysilicic acid, cyclic siloxane solutions of trimethylsiloxysilicic acid, higher alkoxy-modified silicones such as stearoxysilicones, and higher fatty acid-modified silicones.

According to the present invention, Component B can be obtained by modifying the compound having a siloxane bond described above.

Examples include a monoamine-modified silicone oil, a diamine-modified silicone oil, a special amino-modified silicone oil, a carbinol-modified silicone oil, a mercapto-modified silicone oil, a carboxyl-modified silicone oil, an amino polyether-modified silicone oil, an epoxy polyether-modified silicone oil, a reactive silicone oil, a polyether-modified silicone oil, a phenol-modified silicone oil, a silanol-modified silicone oil, a side-chain amino-both terminal (dual-end) methoxy-modified silicone oil, and a diol-modified silicone oil. These silicone oils having active hydrogen atoms can be used.

Among the silicone oils having two or more active hydrogen atoms in the molecule, both terminal-modified silicone oils (dual-end modified silicone oils) are preferable. Examples include a both terminal amino-modified silicone oil (a dual-end amino-modified silicone oil), a both terminal carbinol-modified silicone oil (a dual-end carbinol-modified silicone oil), a both terminal polyether-modified silicone oil (a dual-end polyether-modified silicone oil), a both terminal mercapto-modified silicone oil (a dual-end mercapto-modified silicone oil), a both terminal carboxy-modified silicone oil (a dual-end carboxy-modified silicone oil), a both terminal phenol-modified silicone oil (a dual-end phenol-modified silicone oil), and a both terminal silanol-modified silicone oil (a dual-end silanol-modified silicone oil).

Furthermore, single terminal-modified silicone oils (single-end modified silicone oils) or side chain-modified silicone oils can also be used. Examples include a single terminal diol-modified silicone oil (a single-end diol-modified silicone oil), a side chain monoamine-modified silicone oil, a side chain diamine-modified silicone oil, a side chain carbinol-modified silicone oil, a side chain carboxy-modified silicone oil, a side chain amino polyether-modified silicone oil, and a side chain epoxy polyether-modified silicone oil.

Among them, from the viewpoints of reactivity, and handleability such as odor or irritability, a both terminal carbinol-modified silicone oil, a both terminal amino-modified silicone oil, and a single terminal diol-modified silicone oil are preferable, and a both terminal carbinol-modified silicone oil and a single terminal diol-modified silicone oil are more preferable, while a both terminal carbinol-modified silicone oil is even more preferable.

Furthermore, the number average molecular weight of Component B is preferably from 500 to 30,000, and more preferably from 500 to 20,000. When the number average molecular weight is in this range, there is a tendency that the suitability to solvent inks due to siloxane bonds is sufficiently exhibited, and fluidity as well as compatibility between Component B and Component A can be secured. Therefore, handling of the composition is easy, and it is preferable. The number average molecular weight as used herein is a value measured using gel permeation chromatography, and calculated relative to calibrated polystyrene standards having known molecular weights.

When a both terminal-modified silicone oil is used as Component B, the number average molecular weight of Component B is preferably 500 to 10,000, more preferably 500 to 5,000, and even more preferably 500 to 3,000.

When a single terminal-modified silicone oil and/or a side chain-modified silicone oil is used as Component B, the number average molecular weight of Component B is preferably from 1,000 to 30,000, and more preferably from 10,000 to 20,000.

As Component B, commercially available products can also be employed, and examples include, as the both terminal amino-modified silicone oil, KF-8010, X-22-161A (manufactured by Shin-Etsu Chemical Co., Ltd.); as the both terminal carbinol-modified silicone oil, X-22-160AS, KF-6003 (manufactured by Shin-Etsu Chemical Co., Ltd.), and BY 16-004 (manufactured by Dow Corning Toray Co., Ltd.); and as the single terminal diol-modified silicone oil, X-22-176DX, X-22-176F (manufactured by Shin-Etsu Chemical Co., Ltd.).

The content of Component B in the resin composition for laser engraving is preferably 5 wt % to 80%, more preferably 15 wt % to 60 wt %, and even more preferably 30 wt % to 50 wt %, relative to the solids content excluding volatile components (solvent).

Meanwhile, from the viewpoint of reactivity, the equivalents (molar ratio) of the isocyanato groups in Component A and the active hydrogen atoms in Component B is preferably 70:30 to 30:70, more preferably 60:40 to 40:60, and even more preferably 55:45 to 45:55. It is preferable to appropriately adjust the amounts of Component A and Component B added, so as to have the equivalents in the range described above.

The resin composition for laser engraving of the present invention comprises Component A and Component B as essential components, and may also comprise other components. Examples of the other components include, but are not limited to, (Component C) a compound which does not contain a siloxane bond in the molecule but has two or more active hydrogen atoms, (Component D), a radical polymerizable compound, (Component E) a polymerization initiator, (Component F) a photothermal conversion agent capable of absorbing light having a wavelength of 700 to 1,300 nm, (Component G) a plasticizer, and (Component H) a compound having a hydrolyzable silyl group and/or a silanol group.

Meanwhile, the various compounds of Component C to Component H are compounds excluding Component A and Component B. Those compounds that literally correspond to Component A or Component B, and also correspond to Component C to Component H are considered to be corresponding to Component A or Component B.

(Component C) Compound which does not Contain Siloxane Bond in Molecule and has Two or More Active Hydrogen Atoms The resin composition for laser engraving of the present invention preferably comprises (Component C) a compound which does not contain a siloxane bond in the molecule and contains two or more active hydrogen atoms.

From the viewpoint that the progress of the reaction is rapid and a high strength film is obtained, Component C is preferably a compound having one or more functional groups selected from the group consisting of a primary amino group and an acid anhydride group, or a compound having two or more functional groups selected from the group consisting of a secondary amino group, a mercapto group, a carboxyl group, a phenolic hydroxyl group and a hydroxyl group. Component C is more preferably a compound having one or more functional groups selected from the group consisting of a primary amino group and an acid anhydride group, or a compound having two or more functional groups selected from the group consisting of a secondary amino group and a mercapto group, and is even more preferably a compound having one or more functional groups selected from the group consisting of a primary amino group and an acid anhydride group.

The compound having at least one primary amino group is not particularly limited, and various types thereof may be used.

Examples thereof include primary alkylamines such as butylamine, octylamine, oleylamine and 2-ethylhexylamine, primary anilines such as aniline, 4-aminoacetophenone, p-anisidine, 2-aminoanthracene and 1-naphthylamine, primary alkanolamines such as monoethanolamine, 2-ethoxyethanolamine and 2-hydroxypropanolamine, aliphatic polyamines such as hexanediamine, ethylenediamine, diethylenetriamine, triethylenetetramine, tetraethylenepentamine, m-xylenediamine and p-xylenediamine, alicyclic polyamines such as 1,3-diaminocyclohexane and isophoronediamine, polyanilines such as 1,4-phenylenediamine, 2,3-diaminonaphthalene, 2,6-diaminoanthraquinone, 2,2-bis(4-aminophenyl)hexafluoropropane, 4,4'-diaminobenzophenone and 4,4'-diaminodiphenylmethane, Mannich bases consisting of a polycondensate of polyamines, an aldehyde compound, and mono- or polyvalent phenols, and polyamidopolyamines obtained by the reaction of polyamines with polycarboxylic acid or dimer acid.

Among these, because of the suitability for forming a high degree of three dimensional crosslinking, aliphatic polyamines, alicyclic polyamines and polyanilines are preferable, and, in particular, hexanediamine, triethylenetetramine, m-xylenediamine and 4,4'-diaminodiphenylmethane are more preferable.

The compound having at least two secondary amino groups is not particularly limited, and various types thereof may be used.

Examples thereof include N,N'-dimethylethylenediamine, N,N'-diethylethylenediamine, N,N'-dibenzylethylenediamine, N,N'-diisopropylethylenediamine, 2,5-dimethylpiperazine, N,N'-dimethylcyclohexane-1,2-diamine, piperazine, homopiperazine, 2-methylpiperazine, etc.

The compound having at least one acid anhydride group is not particularly limited, and various types thereof may be used.

Usable examples thereof include acid anhydride compounds such as succinic anhydride, maleic anhydride, phthalic anhydride, hexahydrophthalic anhydride, methylhexahydrophthalic anhydride, nadic anhydride, hydrogenated nadic anhydride, trimellitic anhydride, and pyromellitic anhydride. Among these, the use of methylhexahydrophthalic anhydride is particularly preferable, which gives a cured film that shows a little cure shrinkage and has transparency and high strength.

The compound having at least two mercapto groups is not particularly limited, and various types thereof may be used.

Examples thereof include alkanedithiols such as 1,2-ethanedithiol, 1,3-propanedithiol, 1,4-butanedithiol, 1,5-pentanedithiol, 1,6-hexanedithiol, 1,7-heptanedithiol, 1,8-octanedithiol, 1,9-nonanedithiol, 1,10-decanedithiol, 1,12-dodecanedithiol, 2,2-dimethyl-1,3-propanedithiol, 3-methyl-1,5-pentanedithiol and 2-methyl-1,8-octanedithiol, cycloalkanedithiols such as 1,4-cyclohexanedithiol, alkanedithiols containing a hetero atom in a carbon chain such as bis(2-mercaptoethyl)ether, bis(2-mercaptoethyl)sulfide, bis(2-mercaptoethyl)disulfide and 2,2'-(ethylenedithio)diethanethiol, alkanedithiols containing a hetero atom and an alicyclic structure in a carbon chain such as 2,5-bis(mercaptomethyl)-1,4-dioxane and 2,5-bis(mercaptomethyl)-1,4-dithiane, alkanetrithiols such as 1,1,1-tris(mercaptomethyl)ethane, 2-ether-2-mercaptomethyl-1,3-propanedithiol and 1,8-mercapto-4-mercaptomethyl-3,6-thiaoctane, alkanetetrathiols such as tetrakis(mercaptomethyl)methane, 3,3'-thiobis(propane-1,2-dithiol), 2,2'-thiobis(propane-1,3-dithiol), etc.

The compound having at least two carboxyl groups is not particularly limited, and various types thereof may be used.

Examples thereof include succinic acid, maleic acid, phthalic acid, hexahydrophthalic acid, methylhexahydrophthalic acid, nadic acid, hydrogenated nadic acid, trimellitic acid, pyromellitic acid, adipic acid, sebacic acid, dodecanedicarboxylic acid, isophthalic acid, 2-methylterephthalic acid, naphthalenedicarboxylic acid, etc.

The compound having at least two phenolic hydroxyl groups is not particularly limited, and various types thereof may be used.

Examples thereof include novolac type resins such as phenolnovolac resin, cresolnovolac resin and naphtholnovolac resin; polyfunctional type phenol resins such as triphenolmethane type resin; modified phenol resins such as dicyclopentanediene-modified phenol resin and terpene-modified phenol resin; aralkyl type resins such as phenolaralkyl resin having a phenylene skeleton, phenolaralkyl resin having a biphenylene skeleton, naphtholaralkyl resin having a phenylene skeleton and naphtholaralkyl resin having a biphenylene skeleton; bisphenol compounds such as bisphenol A and bisphenol F; a sulfur atom-containing type phenol resins such as bisphenol S, etc.

As the compound having at least two hydroxyl groups, various kinds may be used, without particular limitations.

Examples thereof include ethylene glycol, diethylene glycol, propylene glycol, dipropylene glycol, trymethylene glycol, 1,4-tetramethylenediol, 1,3-tetramethylenediol, 2-methyl-1,3-trymethylenediol, 1,5-pentamethylenediol, neopentyl glycol, 1,6-hexamethylenediol, 3-methyl-1,5-pentamethylenediol, 2,4-diethyl-1,5-pentamethylenediol, glycerin, trimethylolpropane, trimethylolethane, cyclohexanediols (such as 1,4-cyclohexanediol), bisphenols (such as bisphenol A), sugar alcohols (such as xylitol and sorbitol), polyalkylene glycols such as polyethylene glycol, polypropylene glycol and polytetramethylene glycol, etc.

The compounds shown below can be cited as specific preferred examples of Component C, but the present invention should not be construed as being thereto.

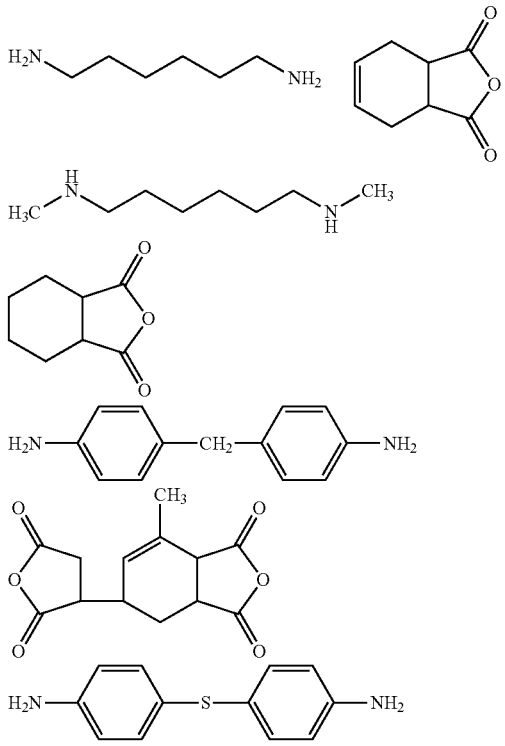

-continued

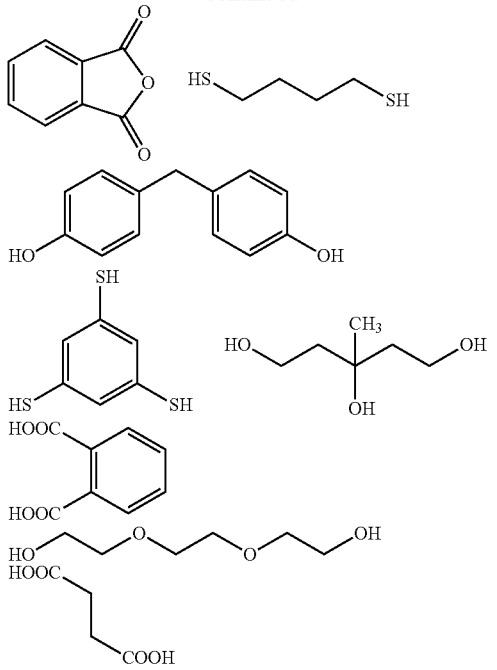

With regard to Component C in the present invention, one type may be used on its own or two or more types may be used in combination.

The content of Component C in the resin composition is preferably 0.01 to 40 wt % relative to the total solids content by weight of the resin composition, more preferably 0.05 to 30 wt %, and yet more preferably 0.1 to 20 wt %.

(Component D) Radically Polymerizable Compound

The resin composition for laser engraving of the present invention preferably comprises (Component D) a radically polymerizable compound. As the radically polymerizable compound, a polyfunctional ethylenically unsaturated compound is preferable, and a monofunctional ethylenically unsaturated compound may also be included in combination with the polyfunctional ethylenically unsaturated compound.

(Component D-1) Polyfunctional Ethylenically Unsaturated Compound

As the polyfunctional ethylenically unsaturated compound, compounds having 2 to 20 terminal ethylenically unsaturated groups are preferable. These compound groups are widely known in the present industrial field, and, in the present invention, these may be used without particular limitation. These have chemical forms such as a monomer, a prepolymer, that is, a dimer, a trimer and an oligomer, or copolymers thereof, and mixtures thereof.

Examples of compounds from which the ethylenically unsaturated group in the polyfunctional ethylenically unsaturated compound is derived include unsaturated carboxylic acids (such as acrylic acid, methacrylic acid, itaconic acid, crotonic acid, isocrotonic acid and maleic acid), and esters and amides thereof. Preferably esters of an unsaturated carboxylic acid and an aliphatic polyhydric alcoholic compound, or amides of an unsaturated carboxylic acid and an aliphatic polyvalent amine compound are used. Moreover, addition reaction products of unsaturated carboxylic acid esters or amides having a nucleophilic substituent such as a hydroxyl group or an amino group with polyfunctional isocyanates or epoxides, and dehydrating condensation reaction products with a polyfunctional carboxylic acid, etc. are also used favorably. Moreover, addition reaction products of unsaturated carboxylic acid esters or amides having an electrophilic substituent such as an isocyanato group or an epoxy group with monofunctional or polyfunctional alcohols or amines, and substitution reaction products of unsaturated carboxylic acid esters or amides having a leaving group such as a halogen group or a tosyloxy group with monofunctional or polyfunctional alcohols or amines are also favorable. Moreover, as another example, the use of compounds obtained by replacing the unsaturated carboxylic acid with a vinyl compound, an allyl compound, an unsaturated phosphonic acid, styrene or the like is also possible.

From the viewpoint of the reactivity, the ethylenically unsaturated group contained in the polyfunctional ethylenically unsaturated compound is preferably a residue of each of acrylates, methacrylates, vinyl compounds and allyl compounds. From the viewpoint of the printing durability, the polyfunctional ethylenically unsaturated compound more preferably comprises three or more ethylenically unsaturated groups.

Specific examples of ester monomers of an aliphatic polyhydric alcohol compound and an unsaturated carboxylic acid include acrylic acid esters such as ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri (acryloyloxyethyl) isocyanurate, and a polyester acrylate oligomer.

Examples of methacrylic acid esters include tetramethylene glycol dimethacrylate, triethylene glycol dimethacrylate, neopentyl glycol dimethacrylate, trimethylolpropane trim et ha cry late, trimethylolethane trimethacrylate, ethylene glycol dimethacrylate, diethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)phenyl]dimethylmethane, and bis[p-(methacryloxyethoxy)phenyl]dimethylmethane.

Examples of the itaconic acid ester include ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate.

Examples of the crotonic acid ester include ethylene glycol dicrotonate, tetramethylene glycol dicrotonate, pentaerythritol dicrotonate, and sorbitol tetracrotonate.

Examples of the isocrotonic acid ester include ethylene glycol diisocrotonate, pentaerythritol diisocrotonate, and sorbitol tetraisocrotonate.

Examples of the maleic acid ester include ethylene glycol dimaleate, triethylene glycol dimaleate, pentaerythritol dimaleate, and sorbitol tetramaleate.

As examples of other esters, for example, aliphatic alcohol-based esters described in JP-B-46-27926 (JP-B denotes a Japanese examined patent application publication), JP-B-51-47334, and JP-A-57-196231, those having an aromatic skeleton described in JP-A-59-5240, JP-A-59-5241, and JP-A-2-

226149, and those containing an amino group described in JP-A-1-165613 may suitably be used.

The above-mentioned ester-based monomer may be used on their own or as a mixture of two or more types thereof.

Specific examples of an amide monomer from an aliphatic polyvalent amine compound and an unsaturated carboxylic acid include methylene bis(meth)acrylamide, 1,6-hexamethylene bis(meth)acrylamide, diethylenetriamine tris(meth) acrylamide, and xylylene bis(meth)acrylamide.

Examples of other preferred amide-based monomer include those having a cyclohexylene structure described in JP-B-54-21726.

Furthermore, as a polyfunctional ethylenically unsaturated compound, a urethane-based addition-polymerizable polyfunctional compound produced by an addition reaction of an isocyanate and a hydroxy group is also suitable. Specific examples thereof include a vinyl urethane compound containing two or more polymerizable vinyl groups per molecule in which a polyisocyanate compound having two or more isocyanato groups per molecule described in JP-B-48-41708 is added to a hydroxy group-containing vinyl monomer represented by Formula (i) below.

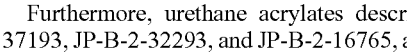

$$CH_2{=}C(R)COOCH_2CH(R')OH \quad (i)$$

(R and R' independently denote H or $CH_3$.)

Furthermore, urethane acrylates described in JP-A-51-37193, JP-B-2-32293, and JP-B-2-16765, and urethane compounds having an ethylene oxide-based skeleton described in JP-B-58-49860, JP-B-56-17654, JP-B-62-39417, and JP-B-62-39418 are also suitable.

Furthermore, by use of addition-polymerizable compounds having an amino structure in the molecule described in JP-A-63-277653, JP-A-63-260909, and JP-A-1-105238, a resin composition for laser engraving which can crosslink in a short time can be obtained.

Other examples of the polyfunctional ethylenically unsaturated compound include polyester acrylates such as those described in JP-A-48-64183, JP-B-49-43191, and JP-B-52-30490, and polyfunctional acrylates and methacrylates such as epoxy acrylates etc. formed by a reaction of an epoxy resin and (meth)acrylic acid. Examples also include specific unsaturated compounds described in JP-B-46-43946, JP-B-1-40337, and JP-B-1-40336, and vinylphosphonic acid-based compounds described in JP-A-2-25493. In some cases, perfluoroalkyl group-containing structures described in JP-A-61-22048 are suitably used. Moreover, those described as photocuring monomers or oligomers in the Journal of the Adhesion Society of Japan, Vol. 20, No. 7, pp. 300 to 308 (1984) may also be used.

Examples of the vinyl compounds include butanediol-1,4-divinyl ether, ethylene glycol divinyl ether, 1,2-propanediol divinyl ether, 1,3-propanediol divinyl ether, 1,3-butanediol divinyl ether, 1,4-butanediol divinyl ether, neopentyl glycol divinyl ether, trimethylolpropane tirvinyl ether, trimethylolethane trivinyl ether, hexanediol divinyl ether, tetraethylene glycol divinyl ether, pentaerythritol divinyl ether, pentaerythritol trivinyl ether, pentaerythritol tetravinyl ether, sorbitol tetravinyl ether, sorbitol pentavinyl ether, ethylene glycol diethylenevinyl ether, ethylene glycol dipropylenevinyl ether, trimethylolpropane triethylenevinyl ether, trimethylolpropane diethylenevinyl ether, pentaerythritol diethylenevinyl ether, pentaerythritol triethylenevinyl ether, pentaerythritol tetraethylenevinyl ether, 1,1,1-tris[4-(2-vinyloxyethoxy) phenyl]ethane, bisphenol A divinyloxyethyl ether, divinyl adipate, etc.

Examples of the allyl compounds include polyethylene glycol diallyl ether, 1,4-cyclohexane diallyl ether, 1,4-diethylcyclohexyl diallyl ether, 1,8-octane diallyl ether, trimethylolpropane diallyl ether, trimethylolethane triallyl ether, pentaerythritol triallyl ether, pentaerythritol tetraallyl ether, dipentaerythritol pentaallyl ether, dipentaerythritol hexaallyl ether, diallyl phthalate, diallyl terephthalate, diallyl isophthalate, triallyl isocyanurate, triallyl phosphate, etc.

Particularly, since the intersolubility of Component A and Component B is excellent, and the crosslinked portion has the same low temperature degradable skeleton as that of an acrylic resin, Component D-1 is more preferably a (meth) acrylate compound from the viewpoint of increasing the engraving sensitivity.

Among these, preferred examples of Component D-1 include diethylene glycol di(meth)acrylate, dipentaerythritol hexa(meth)acrylate, tricyclodecanedimethanol di(meth) acrylate, trimethylolpropane tri(meth)acrylate, pentaerythritol tetra(meth)acrylate, and 1,6-hexanediol di(meth)acrylate.

The resin composition for laser engraving of the present invention may use only one kind of Component D-1, or may use two or more kinds of Component D-1 in combination.

The total content of (Component D-1) a polyfunctional ethylenically unsaturated compound in the resin composition for laser engraving of the present invention is preferably 0.1 wt % to 40 wt %, and more preferably in the range of 1 wt % to 20 wt %, relative to the total solids content of the resin composition from the viewpoint of the flexibility and brittleness of the crosslinked film.

(Component D-2) Monofunctional Ethylenically Unsaturated Compound

The resin composition for laser engraving of the present invention may comprise (Component D-2) a monofunctional ethylenically unsaturated compound, but if the resin composition comprises (Component D-2) a monofunctional ethylenically unsaturated compound, it is preferable that the resin composition comprise Component D-2 in combination with (Component D-1) a polyfunctional ethylenically unsaturated compound.

Examples of the monofunctional ethylenically unsaturated compound having one ethylenically unsaturated bond in the molecule include esters of unsaturated carboxylic acids (for example, acrylic acid, methacrylic acid, itaconic acid, crotonic acid, isocrotonic acid, and maleic acid) and monohydric alcohol compounds, and amides of unsaturated carboxylic acids and monovalent amine compounds.

Furthermore, addition reaction products of an unsaturated carboxylic acid ester or amide having a nucleophilic substituent such as a hydroxyl group, an amino group or a mercapto group, and an isocyanate or an epoxide, and dehydration condensation reaction products with a monofunctional or polyfunctional carboxylic acid, are also suitably used.

Furthermore, addition reaction products of an unsaturated carboxylic acid ester or amide having an electrophilic substituent such as an isocyanato group or an epoxy group, and an alcohol, an amine or a thiol, and substitution reaction products of an unsaturated carboxylic acid ester or amide having a detachable substituent such as a halogeno group or a tosyloxy group, and an alcohol, an amine or a thiol, are also suitable.

Also, as other examples, a group of compounds substituted with unsaturated phosphonic acid, styrene, vinyl ether or the like instead of the unsaturated carboxylic acid described above, can also be used.

The polymerizable compound is not particularly limited, and various known compounds can be used in addition to the compounds exemplified above. For example, those compounds described in JP-A-2009-204962 and the like may also be used.

The resin composition for laser engraving of the present invention may use only one kind of Component D-2, or may use two or more kinds of Component D-2 in combination.

The total content of (Component D-2) a monofunctional ethylenically unsaturated compound in the resin composition for laser engraving of the present invention is preferably 0.1 wt % to 40 wt %, and more preferably in the range of 1 wt % to 20 wt %, relative to the total solids content of the resin composition, from the viewpoint of the flexibility or brittleness of the crosslinked film.

(Component E) Polymerization Initiator

In order to facilitate the formation of crosslinking structures, the resin composition for laser engraving of the present invention preferably comprises (Component E) a polymerization initiator, and more preferably contains (Component D-1) a polyfunctional ethylenically unsaturated compound and (Component E) a polymerization initiator.

As the polymerization initiator, well-known examples among those known art may be used without particular limitations. Hereinafter, although the radical polymerization initiator which is a preferable polymerization initiator will be described, the present invention is not limited by this description.

In the present invention, preferable radical polymerization initiators include (a) aromatic ketones, (b) onium salt compounds, (c) organic peroxides, (d) thio compounds, (e) hexaallylbiimidazole compounds, (f) ketoxime ester compounds, (g) borate compounds, (h) azinium compounds, (i) metallocene compounds, (j) active ester compounds, (k) compounds having a carbon halogen bond, and (l) azo compounds. Hereinafter, although specific examples of the (a) to (l) are cited, the present invention is not limited to these.

In the present invention, when applies to the relief-forming layer of the relief printing plate precursor, from the viewpoint of engraving sensitivity and making a favorable relief edge shape, (c) organic peroxides and (l) azo compounds are more preferable, and (c) organic peroxides are particularly preferable.

The (a) aromatic ketones, (b) onium salt compounds, (d) thio compounds, (e) hexaallylbiimidazole compounds, (f) ketoxime ester compounds, (g) borate compounds, (h) azinium compounds, (i) metallocene compounds, (j) active ester compounds, and (k) compounds having a carbon halogen bonding may preferably include compounds described in paragraphs 0074 to 0118 of JP-A-2008-63554.

Moreover, (c) organic peroxides and (l) azo compounds preferably include the following compounds.

(c) Organic Peroxides

Preferable (c) organic peroxides as a radical polymerization initiator that can be used in the present invention include preferably a peroxide ester such as 3,3',4,4'-tetra(t-butylperoxycarbonyl)benzophenone, 3,3',4,4'-tetra(t-amylperoxycarbonyl)benzophenone, 3,3',4,4'-tetra(t-hexylperoxycarbonyl)benzophenone, 3,3',4,4'-tetra(t-octylperoxycarbonyl)benzophenone, 3,3',4,4'-tetra(cumylperoxycarbonyl)benzophenone, 3,3',4,4'-tetra(p-isopropylcumylperoxycarbonyl)benzophenone and d i-t-butyldiperoxyisophthalate.

(l) Azo Compounds

Preferable (l) azo compounds as a radical polymerization initiator that can be used in the present invention include those such as 2,2'-azobisisobutyronitrile, 2,2'-azobispropionitrile, 1,1'-azobis(cyclohexane-1-carbonitrile), 2,2'-azobis(2-methylbutyronitrile), 2,2'-azobis(2,4-dimethylvaleronitrile), 2,2'-azobis(4-methoxy-2,4-dimethylvaleronitrile), 4,4'-azobis(4-cyanovaleric acid), dimethyl 2,2'-azobis(isobutyrate), 2,2'-azobis(2-methylpropionamideoxime), 2,2'-azobis[2-(2-imidazolin-2-yl)propane], 2,2'-azobis{2-methyl-N-[1,1-bis(hydroxymethyl)-2-hydroxyethyl]propionamide}, 2,2'-azobis[2-methyl-N-(2-hydroxyethyl)propionamide], 2,2'-azobis(N-butyl-2-methylpropionamide), 2,2'-azobis(N-cyclohexyl-2-methylpropionamide), 2,2'-azobis[N-(2-propenyl)-2-methyl-propionamide], 2,2'-azobis(2,4,4-trimethylpentane).

In addition, in the present invention, the (c) organic peroxides as a polymerization initiator of the invention are preferable from the viewpoint of membranous (relief-forming layer) crosslinking property, furthermore, as an unexpected effect, a particularly preferable effect was found from the viewpoint of the improvement in engraving sensitivity.

(Component F) Photothermal Conversion Agent Capable of Absorbing Light having a Wavelength of 700 to 1,300 nm The resin composition for laser engraving of the present invention preferably further comprises (Component F) a photothermal conversion agent capable of absorbing light having a wavelength of 700 to 1,300 nm (hereinafter, simply called "photothermal conversion agent"). That is, it is considered that the photothermal conversion agent in the present invention can promote the thermal decomposition of a cured material during laser engraving by absorbing laser light and generating heat. Therefore, it is preferable that a photothermal conversion agent capable of absorbing light having a wavelength of laser used for graving be selected.

When a laser (a YAG laser, a semiconductor laser, a fiber laser, a surface emitting laser, etc.) emitting infrared at a wavelength of 700 to 1,300 nm is used as a light source for laser engraving, it is preferable for the relief-forming layer in the present invention to comprise a photothermal conversion agent that has a maximum absorption wavelength at 700 to 1,300 nm.

As the photothermal conversion agent in the present invention, various types of dye or pigment are used.

With regard to the photothermal conversion agent, examples of dyes that can be used include commercial dyes and known dyes described in publications such as 'Senryo Binran' (Dye Handbook) (Ed. by The Society of Synthetic Organic Chemistry, Japan, 1970). Specific examples include dyes having a maximum absorption wavelength at 700 to 1,300 nm, such as azo dyes, metal complex salt azo dyes, pyrazolone azo dyes, naphthoquinone dyes, anthraquinone dyes, phthalocyanine dyes, carbonium dyes, diimmonium compounds, quinone imine dyes, methine dyes, cyanine dyes, squarylium colorants, pyrylium salts, and metal thiolate complexes.

In particular, cyanine-based colorants such as heptamethine cyanine colorants, oxonol-based colorants such as pentamethine oxonol colorants, and phthalocyanine-based colorants are preferably used. Examples include dyes described in paragraphs 0124 to 0137 of JP-A-2008-63554.

With regard to the photothermal conversion agent used in the present invention, examples of pigments include commercial pigments and pigments described in the Color Index (C.I.) Handbook, 'Saishin Ganryo Binran' (Latest Pigments Handbook) (Ed. by Nippon Ganryo Gijutsu Kyokai, 1977), 'Saishin Ganryo Ouyogijutsu' (Latest Applications of Pigment Technology) (CMC Publishing, 1986), and 'Insatsu Inki Gijutsu' (Printing Ink Technology) (CMC Publishing, 1984).

Examples of the type of pigment include a black pigment, a yellow pigment, an orange pigment, a brown pigment, a red pigment, a purple pigment, a blue pigment, a green pigment, a fluorescent pigment, a metal powder pigment and, in addition, polymer-binding colorants. Specifically, an insoluble azo pigment, an azo lake pigment, a condensed azo pigment, a chelate azo pigment, a phthalocyanine type pigment, an anthraquinone type pigment, perylene and perinone type pigments, a thioindigo type pigment, a quinacridone type pigment, a dioxazine type pigment, an isoindolinone type pigment, a quinophthalone type pigment, a dye lake pigment, an azine pigment, a nitroso pigment, a nitro pigment, a natural pigment, a fluorescent pigment, an inorganic pigment, carbon black, etc. may be used. Among these pigments, carbon black is preferable.

Any carbon black, regardless of classification by ASTM (American Society for Testing and Materials) and application (e.g. for coloring, for rubber, for dry cell, etc.), may be used as long as dispersibility, etc. in the resin composition for laser engraving is stable. Carbon black includes for example furnace black, thermal black, channel black, lamp black, and acetylene black. In order to make dispersion easy, a black colorant such as carbon black may be used as color chips or a color paste by dispersing it in nitrocellulose or a binder in advance using, as necessary, a dispersant, and such chips and paste are readily available as commercial products.

In the present invention, it is possible to use carbon black having a relatively low specific surface area and a relatively low dibutyl phthalate (DBP) absorption and also finely divided carbon black having a large specific surface area. Preferred examples of carbon black include Printex (registered trademark) U, Printex (registered trademark) A, Spezialschwarz (registered trademark) 4 (Degussa), and #45L (Mitsubishi Chemical Corporation).

The DBP absorption of the carbon black that can be used in the present invention is preferable less than 150 mL/100 g, more preferably no greater than 100 mL/100 g, and yet more preferably no greater than 70 mL/100 g.

From the viewpoint of improving engraving sensitivity by efficiently transmitting heat generated by photothermal conversion to the surrounding polymer, etc., the carbon black that can be used in the present invention is preferably a conductive carbon black having a specific surface area of at least 100 $m^2/g$.

With regard to Component F in the resin composition for laser engraving of the present invention, one type may be used on its own, or two or more types may be used in combination.

The content of (Component F) the photothermal conversion agent capable of absorbing light having a wavelength of 700 to 1,300 nm in the resin composition for laser engraving of the present invention greatly varies depending on the molecular extinction coefficient inherent to the molecule, and, relative to the total solid content of the resin composition, 0.01 to 20 wt % is preferable, 0.05 to 10 wt % is more preferable, and 0.1 to 5 wt % is particularly preferable.

(Component G) Plasticizer

From the viewpoint of imparting flexibility which is needed for flexographic printing plate, the resin composition for laser engraving of the present invention preferably further comprises (Component G) a plasticizer.

A plasticizer known as a polymer plasticizer may be used without limitations; examples thereof include, as described in pp. 211 to 220 of 'Kobunshi Daijiten (Polymer Dictionary)' (first edition, 1994, Maruzen Co., Ltd.), an adipic acid derivative, an azelaic acid derivative, a benzoylic acid derivative, a citric acid derivative, an epoxy derivative, a glycol derivative, a hydrocarbon and a derivative thereof, an oleic acid derivative, a phosphoric acid derivative, a phthalic acid derivative, a polyester type, a ricinoleic acid derivative, a sebacic acid derivative, a stearic acid derivative, a sulfonic acid derivative, a terpene and a derivative thereof, and a trimellitic acid derivative. Among them, from the viewpoint of the large ability of reducing a glass transition temperature, an adipic acid derivative, a citric acid derivative, and a phosphoric acid derivative are preferable.

As the adipic acid derivative, dibutyl adipate and 2-butoxyethyl adipate are preferable.

As the citric acid derivative, tributyl citrate is preferable.

As the phosphoric acid derivative, tributyl phosphate, tri(2-ethylhexyl)phosphate, tributoxyethyl phosphate, triphenyl phosphate, cresyldiphenyl phosphate, tricresyl phosphate, t-butylphenyl phosphate and 2-ethylhexyldiphenyl phosphate are preferable.

With regard to Component G in the resin composition for laser engraving of the present invention, one type may be used on its own, or two or more types may be used in combination.

As the content of Component G of the resin composition for laser engraving, from the viewpoint of reducing a glass transition temperature to room temperature or lower, when taking the total weight of the resin composition as 100 wt %, 1 to 50 wt % is preferable, 10 to 40 wt % is more preferable, and 20 to 30 wt % is yet more preferable in terms of solid content.

(Component H) Compound Having Hydrolyzable Silyl Group and/or Silanol Group

The resin composition for laser engraving of the present invention preferably includes (Component H) a compound having a hydrolyzable silyl group and/or silanol group.

The 'hydrolyzable silyl group' of Component H is a silyl group that has a hydrolyzable group; examples of the hydrolyzable group include an alkoxy group, an aryloxy group, a mercapto group, a halogen atom, an amide group, an acetoxy group, an amino group, and an isopropenoxy group. A silyl group is hydrolyzed to become a silanol group, and a silanol group undergoes dehydration-condensation to form a siloxane bond. Such a hydrolyzable silyl croup or silanol croup is preferably one represented by Formula (1) below.

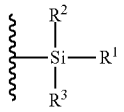

(1)

In Formula (1) above, $R^1$ to $R^3$ independently denote a hydrolyzable group selected from the group consisting of an alkoxy group, an aryloxy group, a mercapto group, a halogen atom, an amide group, an acetoxy group, an amino group, and an isopropenoxy group, a hydroxy group, a hydrogen atom, or a monovalent organic group. In addition, at least one of $R^1$ to $R^3$ denotes a hydrolyzable group selected from the group consisting of an alkoxy group, an aryloxy group, a mercapto group, a halogen atom, an amide group, an acetoxy group, an amino group, and an isopropenoxy group, or a hydroxy group. The wavy line portion denotes the position of bonding to another structure.

A preferred organic group in a case where $R^1$ to $R^3$ represents a monovalent organic group includes an alkyl group having 1 to 30 carbon atoms from the viewpoint of imparting solubility to various organic solvents.

In Formula (1) above, the hydrolyzable group bonded to the silicon atom is particularly preferably an alkoxy group or a halogen atom.

From the viewpoint of rinsing properties and printing durability, the alkoxy group is preferably an alkoxy group having 1 to 30 carbon atoms, more preferably an alkoxy group having 1 to 15 carbon atoms, yet more preferably an alkoxy group having 1 to 5 carbon atoms, and particularly preferably an alkoxy group having 1 to 3 carbon atoms.

Furthermore, examples of the halogen atom include an F atom, a Cl atom, a Br atom, and an I atom, and from the viewpoint of ease of synthesis and stability it is preferably a Cl atom or a Br atom, and more preferably a Cl atom.

Component H is preferably a compound having one or more groups represented by Formula (1) above, and more preferably a compound having two or more. Component H having two or more hydrolyzable silyl groups is particularly preferably used.

Component H having in the molecule two or more silicon atoms having a hydrolyzable group bonded thereto is preferably used.

The number of silicon atoms having a hydrolyzable group bonded thereto contained in Component F is preferably at least 2 but no greater than 6, and most preferably 2 or 3.

A range of 1 to 3 of the hydrolyzable groups may bond to one silicon atom, and the total number of hydrolyzable groups in Formula (1) is preferably in a range of 2 or 3. It is particularly preferable that three hydrolyzable groups are bonded to a silicon atom. When two or more hydrolyzable groups are bonded to a silicon atom, they may be identical to or different from each other.

Specific preferred examples of the alkoxy group include a methoxy group, an ethoxy group, a propoxy group, an isopropoxy group, a butoxy group, a tert-butoxy group, and a benzyloxy group. Examples of the alkoxysilyl group having an alkoxy group bonded thereto include a trialkoxysilyl group such as a trimethoxysilyl group, a triethoxysilyl group, a triisopropoxysilyl group; a dialkoxymonoalkylsilyl group such as a dimethoxymethylsilyl group or a diethoxymethylsilyl group; and a monoalkoxydialkylsilyl group such as a methoxydimethylsilyl group or an ethoxydimethylsilyl group. A plurality of each of these alkoxy groups may be used in combination, or a plurality of different alkoxy groups may be used in combination.

Specific examples of the aryloxy group include a phenoxy group. Examples of the aryloxysilyl group having an aryloxy group bonded thereto include a triaryloxysilyl group such as a triphenoxysilyl group.

Preferred examples of Component H in the present invention include compounds in which a plurality of groups represented by Formula (1) above are bonded via a linking group, and from the viewpoint of the effects, such a linking group is preferably a linking group having a sulfide group, an imino group or a ureylene group.

The representative synthetic method of Component H containing a linking group having a sulfide group, an imino group or a ureylene group is shown below.

<Synthetic Method for Compound Having Hydrolyzable Silyl Group and/or Silanol Group and Having Sulfide Group as Linking Group>

A synthetic method for Component H having a sulfide group as a linking group (hereinafter, called as appropriate a 'sulfide linking group-containing Component H') is not particularly limited, but specific examples thereof include reaction of Component H having a halogenated hydrocarbon group with an alkali metal sulfide, reaction of Component H having a mercapto group with a halogenated hydrocarbon, reaction of Component H having a mercapto group with Component H having a halogenated hydrocarbon group, reaction of Component H having a halogenated hydrocarbon group with a mercaptan, reaction of Component H having an ethylenically unsaturated double bond with a mercaptan, reaction of Component H having an ethylenically unsaturated double bond with Component H having a mercapto group, reaction of a compound having an ethylenically unsaturated double bond with Component H having a mercapto group, reaction of a ketone with Component H having a mercapto group, reaction of a diazonium salt with Component H having a mercapto group, reaction of Component H having a mercapto group with an oxirane, reaction of Component H having a mercapto group with Component H having an oxirane group, reaction of a mercaptan with Component H having an oxirane group, and reaction of Component H having a mercapto group with an aziridine.

<Synthetic Method for Compound Having Hydrolyzable Silyl Group and/or Silanol Group and Having Imino Group as Linking Group>

A synthetic method for Component H having an imino group as a linking group (hereinafter, called as appropriate an 'imino linking group-containing Component H') is not particularly limited, but specific examples include reaction of Component H having an amino group with a halogenated hydrocarbon, reaction of Component H having an amino group with Component H having a halogenated hydrocarbon group, reaction of Component H having a halogenated hydrocarbon group with an amine, reaction of Component H having an amino group with an oxirane, reaction of Component H having an amino group with Component H having an oxirane group, reaction of an amine with Component H having an oxirane group, reaction of Component F having an amino group with an aziridine, reaction of Component H having an ethylenically unsaturated double bond with an amine, reaction of Component H having an ethylenically unsaturated double bond with Component H having an amino group, reaction of a compound having an ethylenically unsaturated double bond with Component H having an amino group, reaction of a compound having an acetylenically unsaturated triple bond with Component H having an amino group, reaction of Component H having an imine-based unsaturated double bond with an organic alkali metal compound, reaction of Component H having an imine-based unsaturated double bond with an organic alkaline earth metal compound, and reaction of a carbonyl compound with Component H having an amino group.

<Synthetic Method for Compound Having Hydrolyzable Silyl Group and/or Silanol Group and Having Ureylene Group (Urea Bond) as Linking Group>

A synthetic method for Component H having an ureylene group (hereinafter, called as appropriate a 'ureylene linking group-containing Component H') as a linking group is not particularly limited, but specific examples include synthetic methods such as reaction of Component H having an amino group with an isocyanate ester, reaction of Component H having an amino group with Component H having an isocyanate ester, and reaction of an amine with Component H having an isocyanate ester.

A silane coupling agent is preferably used as Component H in the preset invention.

Hereinafter, the silane coupling agent suitable as Component H in the present invention will be described.

In the present invention, the functional group in which at least one of an alkoxy group or a halogeno group (halogen atom) is directly bonded to Si atom is called a silane coupling group, and the compound which has one or more silane coupling groups in the molecule is also called a silane coupling agent. The silane coupling group is preferable in which two of more alkoxy groups or halogen atoms are directly bonded to Si atom, particularly preferably three or more alkoxy groups or halogen atoms directly bonded to Si atom.

In the silane coupling agent which is a preferable aspect in the present invention, as a functional group directly bonded to the Si atom, it is indispensable to have at least one or more functional groups selected from an alkoxy group and a halogen atom, and one having an alkoxy group is preferable from the viewpoint of ease of handling of the compound.

Here, with regard to the alkoxy group from the viewpoint of rinsing properties and printing durability, an alkoxy group having 1 to 30 carbon atoms is preferable, an alkoxy group having 1 to 15 carbon atoms is more preferable, and an alkoxy group having 1 to 5 carbon atoms is yet more preferable.

Moreover, as a halogen atom, an F atom, a Cl atom, a Br atom, and an I atom are included; from the viewpoint of ease of synthesis and stability, a Cl atom and a Br atom are preferable, and a Cl atom is more preferable.

The silane coupling agent in the present invention preferably contains at least 1 but no greater than 10 of above silane coupling groups within the molecule from the viewpoint of favorably maintaining a balance of the degree of crosslinking of the film and flexibility, more preferably contains at least 1 but no greater than 5, and particularly preferably contains at least 2 but no greater than 4.

When there are two or more of silane coupling groups, it is preferable that silane coupling groups are connected with the linking group each other. As the linking group includes at least a divalent organic group which may have substituents such as a hetero atom and hydrocarbons, from the viewpoint of high engraving sensitivity, an aspect containing hetero atoms (N, S, O) is preferable, and a linking group containing an S atom is particularly preferable.

From these viewpoints, as the silane coupling agent in the present invention, a compound having in the molecule two silane coupling groups in which the methoxy group or ethoxy group, particularly a methoxy group is bonded to a Si atom as an alkoxy group and these silane coupling groups are bonded through an alkylene group containing a hetero atom (particularly preferably a S atom) is preferable. More specifically, one having a linking group containing a sulfide group is preferable.

Moreover, as another preferred aspect of the linking group connecting together silane coupling groups, a linking group having an oxyalkylene group is included. Since the linking group contains an oxyalkylene group, rinsing properties of engraved residue after laser engraving are improved. As the oxyalkylene group, an oxyethylene group is preferable, and a polyoxyethylene chain in which a plurality of oxyethylene groups are connected is more preferable. The total number of oxyethylene groups in the polyoxyethylene chain is preferably 2 to 50, more preferably 3 to 30, particularly preferably 4 to 15.

Specific examples of the silane coupling agent that can be used in the present invention are shown below. Examples thereof include β-(3,4-epoxycyclohexyl)ethyltrimethoxysilane, γ-glycidoxypropyltrimethoxysilane, γ-glycidoxypropylmethyldiethoxysilane, γ-glycidoxypropyltriethoxysilane, N-(8-aminoethyl)-γ-aminopropylmethyldimethoxysilane, N-(β-aminoethyl)-γ-aminopropyltrimethoxysilane, N-(β-aminoethyl)-γ-aminopropyltriethoxysilane, γ-aminopropyltrimethoxysilane, γ-aminopropyltriethoxysilane, N-phenyl-γ-aminopropyltrimethoxysilane, γ-mercaptopropyltrimethoxysilane, γ-mercaptopropyltriethoxysilane, bis(triethoxysilylpropyl)disulfide, bis(triethoxysilylpropyl)tetrasulfide, 1,4-bis(triethoxysilyl)benzene, bis(triethoxysilyl)ethane, 1,6-bis(trimethoxysilyl)hexane, 1,8-bis(triethoxysilyl)octane, 1,2-bis(trimethoxysilyl)decane, bis(triethoxysilylpropyl)amine, bis(trimethoxysilylpropyl)urea, γ-chloropropyltrimethoxysilane, γ-ureidopropyltriethoxysilane. Other than the above, the compounds shown below can be cited as preferred examples, but the present invention should not be construed as being limited thereto.

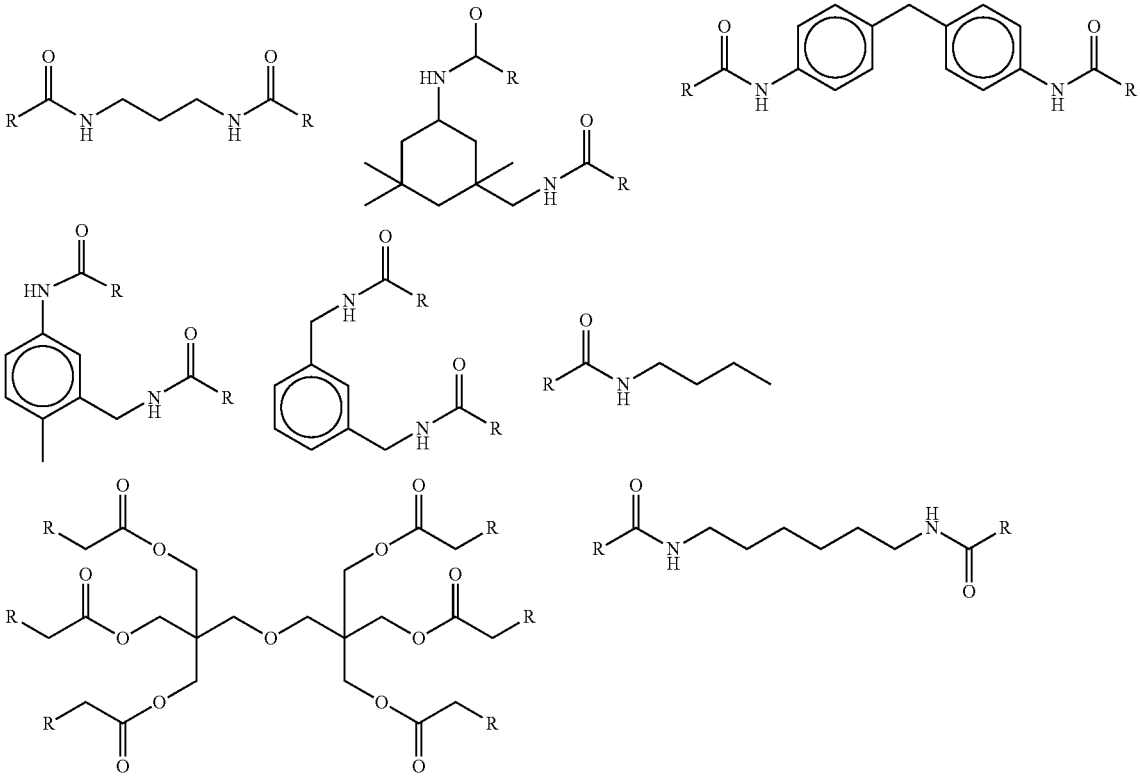

-continued
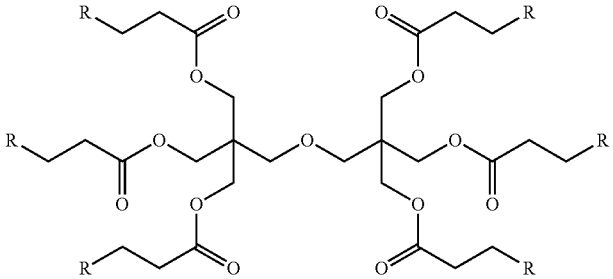
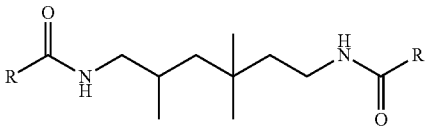
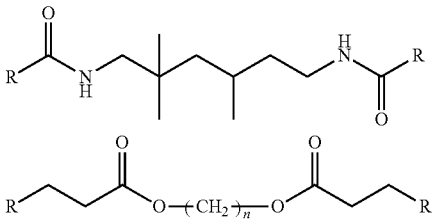
n = 2~20
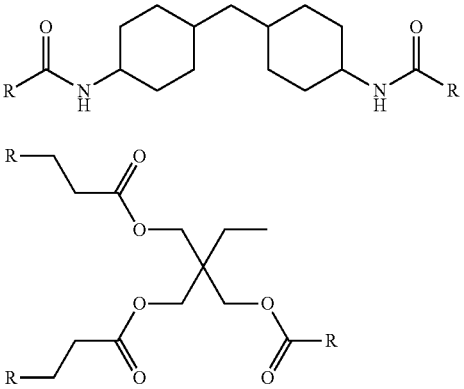
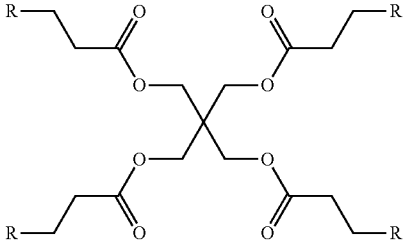
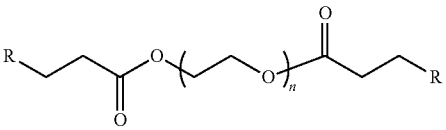
n = 1~50
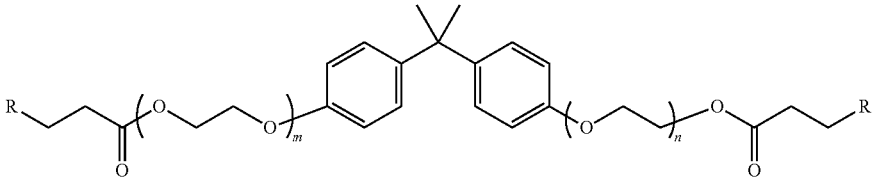
m + n = 2~50
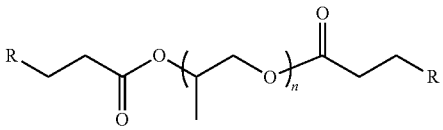
n = 1~50
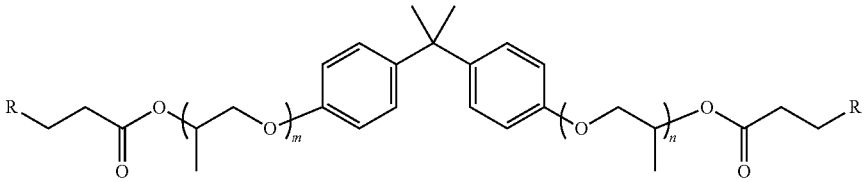
m + n = 2~50
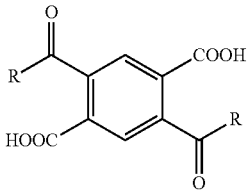
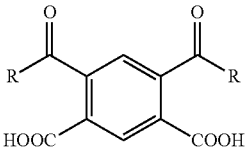
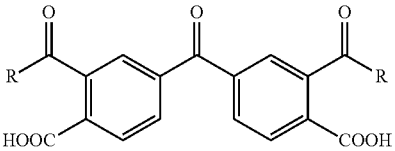

-continued

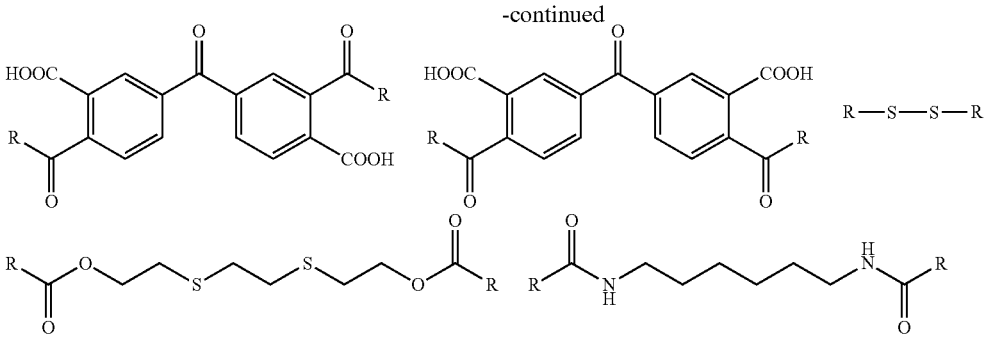

In each of the formulae above, R denotes a partial structure selected from the structures below. When a plurality of Rs and $R^1$s are present in the molecule, they may be identical to or different from each other, and are preferably identical to each other in terms of synthetic suitability. Et in the chemical formulae below denotes an ethyl group, and Me denotes a methyl group.

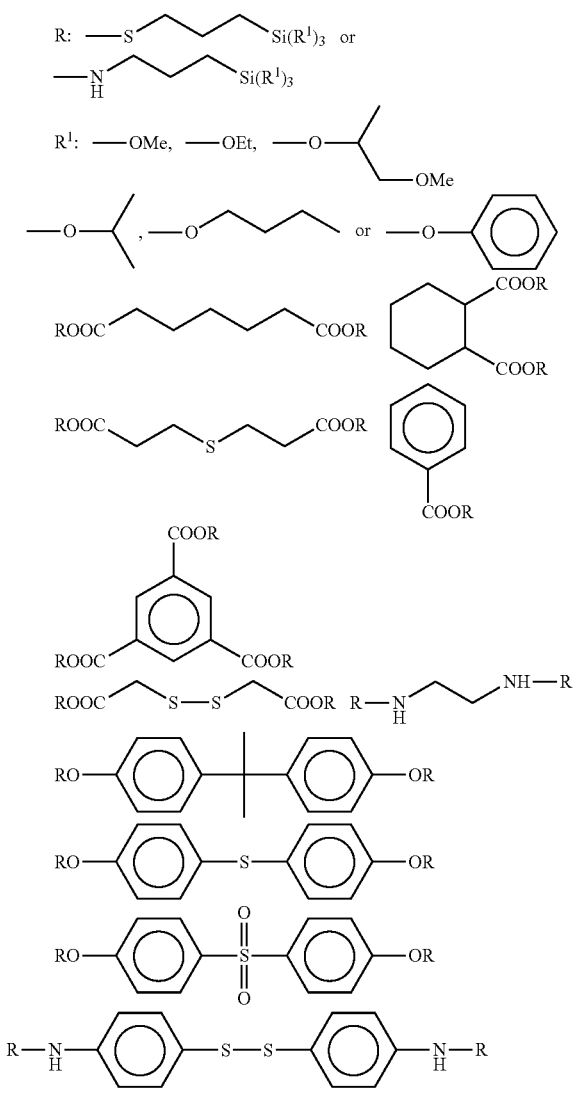

In each of the formulae above, R denotes a partial structure selected from the structures below. $R^1$ is the same as defined above. When a plurality of Rs and $R^1$s are present in the molecule, they may be identical to or different from each other, and are preferably identical to each other in terms of synthetic suitability.

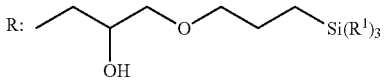

Component H may be obtained by synthesis as appropriate, but use of a commercially available product is preferable in terms of cost. Since Component H corresponds to for example commercially available silane products or silane coupling agents from Shin-Etsu Chemical Co., Ltd., Dow Corning Toray, Momentive Performance Materials Inc., Chisso Corporation, etc., the resin composition of the present invention may employ such a commercially available product by appropriate selection according to the intended application.

As the silane coupling agent in the present invention, a partial hydrolysis-condensation product obtained using one type of compound having a hydrolyzable silyl group and/or a silanol group or a partial cohydrolysis-condensation product obtained using two or more types may be used. Hereinafter, these compounds may be called 'partial (co)hydrolysis-condensation products'.

Specific examples of such a partial (co)hydrolysis-condensation product include a partial (co)hydrolysis condensation product obtained by using, as a precursor, one or more selected from the group of silane compounds consisting of alkoxysilanes or acetyloxysilanes such as tetramethoxysilane, tetraethoxysilane, methyltrimethoxysilane, methyltriethoxysilane, methyltriisopropoxysilane, methyltriacetoxysilane, methyltris(methoxyethoxy)silane, methyltris(methoxypropoxy)silane, ethyltrimethoxysilane, propyltrimethoxysilane, butyl trimethoxysilane, hexyltrimethoxysilane, octyltrimethoxysilane, decyltrimethoxysilane, cyclohexyltrimethoxysilane, phenyltrimethoxysilane, phenyltriethoxysilane, tolyltrimethoxysilane, chloromethyltrimethoxysilane, γ-chloropropyltrimethoxysilane, 3,3,3-trifluoropropyltrimethoxysilane, cyanoethyltriethoxysilane, γ-glycidoxypropyltrimethoxysilane, γ-glycidoxypropyltriethoxysilane, β-(3,4-epoxycyclohexyl)ethyltrimethoxysilane, γ-aminopropyltrimethoxysilane, γ-aminopropyltriethoxysilane, N-β-(aminoethyl)-γ-aminopropyltrimethoxysilane, N-phenyl-γ-aminopropyltrimethoxysilane, γ-mercaptopropyltrimethoxysilane, dimethyldimethoxysilane, dimethyldiethoxysilane, diethyldimethoxysilane, methylethyldimethoxysilane, methylpropyldimethoxysilane, diphenyldimethoxysilane, diphenyldiethoxysilane, methylphenyldimethoxysilane, γ-chloropropylmethyldimethoxysilane, 3,3,3-trifluoropropylmethyldimethoxysilane, γ-glycidoxypropylmethyldiethoxysilane, γ-aminopropylmethyldiethoxysilane, N-β-(aminoethyl)-γ-aminopropylmethyldimethoxysilane and γ-mercaptopropylmethyldiethoxysilane, and an acyloxysilane such as ethoxalyloxysilane.

Among silane compounds as partial (co)hydrolysis-condensation product precursors, from the viewpoint of versatility, cost, and film compatibility, a silane compound having a substituent selected from a methyl group and a phenyl group as a substituent on the silicon is preferable. Specific preferred examples of the precursor include methyltrimethoxysilane, methyltriethoxysilane, phenyltrimethoxysilane, phenyltriethoxysilane, dimethyldimethoxysilane, dimethyldiethoxysilane, diphenyldimethoxysilane, and diphenyldiethoxysilane.

In this case, as a partial (co)hydrolysis-condensation product, it is preferable to use a dimer (2 moles of silane compound is reacted with 1 mole of water to eliminate 2 moles of alcohol, thus giving a disiloxane unit) of the silane compounds cited above to 100-mer of the above-mentioned silane compound, more preferably a dimer to 50-mer, and yet more preferably a dimer to 30-mer, and it is also possible to use a partial (co)hydrolysis-condensation product formed using two or more types of silane compounds as starting materials.

As such a partial (co)hydrolysis-condensation product, ones commercially available as silicone alkoxy oligomers may be used (e.g. those from Shin-Etsu Chemical Co., Ltd.) or ones that are produced in accordance with a standard method by reacting a hydrolyzable silane compound with less than an equivalent of hydrolytic water and then removing by-products such as alcohol and hydrochloric acid may be used. When the production employs, for example, an acyloxysilane or an alkoxysilane described above as a hydrolyzable silane compound starting material, which is a precursor, partial hydrolysis-condensation may be carried out using as a reaction catalyst an acid such as hydrochloric acid or sulfuric acid, an alkali metal or alkaline earth metal hydroxide such as sodium hydroxide or potassium hydroxide, or an alkaline organic material such as triethylamine, and when the production is carried out directly from a chlorosilane, water and alcohol may be reacted using hydrochloric acid by-product as a catalyst.

(Component I) Filler

The resin composition for laser engraving of the present invention preferably comprises (Component I) a filler in order to improve the properties of the cured film of the resin composition for laser engraving.

As the filler, any known filler can be used, and examples include inorganic particles and organic resin particles.

As the inorganic particles, any known inorganic particles can be used, and examples include carbon nanotubes, fullerenes, graphite, silica, alumina, aluminum, and calcium carbonate.

As the organic resin particles, any known organic resin particles can be used, and preferred examples include thermally expandable microcapsules.

An example of the thermally expandable microcapsules may be EXPANCEL (manufactured by Akzo Nobel N.V.).

The resin composition for laser engraving of the present invention may use only one kind of Component I, or may use two or more kinds of Component I in combination.

The content of (Component I) the filler in the resin composition for laser engraving of the present invention is preferably 0.01 wt % to 20 wt %, more preferably 0.05 wt % to 10 wt %, and particularly preferably 0.1 wt % to 5 wt %, relative to the total solids content of the resin composition.

(Component J) Binder Polymer

The resin composition for laser engraving of the present invention may comprise (Component J) a binder polymer (hereinafter, also simply referred to as "binder polymer"), and the content of the component is preferably smaller than the total content of Component A and Component B. The content of Component J is more preferably 50 wt % or less, and even more preferably 10 wt % or less, of the total content of Component A and Component B, and it is particularly preferable that the resin composition does not comprise (Component J) a binder polymer.

The binder polymer is a polymeric component contained in the resin composition for laser engraving, and a general polymer compound may be selected appropriately and used singly or in combination of two or more types. In particular, when the resin composition for laser engraving is to be used as a printing plate precursor, preferably the selection is performed while considering various performances such as laser engraving properties, ink-adhering properties, and dispersion properties of engraved residue.

The binder polymer may be selected and used from polystyrene resin, polyester resin, polyamide resin, polysulfone resin, polyethersulfone resin, polyimide resin, hydrophilic polymer comprising a hydroxyethylene unit, acrylic resin, acetal resin, epoxy resin, polycarbonate resin, rubber, thermoplastic elastomer, etc.

For example, from the viewpoint of laser engraving sensitivity, a polymer comprising a partial structure that is thermally decomposed by exposure or heating is preferable. As such polymer, those described in JP-A-2008-163081, paragraph 0038 are preferably cited. Moreover, when a purpose is to form a film that has softness and flexibility, a soft resin or a thermoplastic elastomer is selected. There is detailed description in JP-A-2008-163081, paragraphs 0039 to 0040. Furthermore, in the case where the resin composition for laser engraving is applied to the relief-forming layer in the relief printing plate precursor for laser engraving, from the viewpoint of easiness of preparing a composition for the relief-forming layer and improvement of resistance properties for an oil-based ink in the relief printing plate to be obtained, the use of a hydrophilic or alcoholphilic polymer is preferable. As the hydrophilic polymer, those described in detail in JP-A-2008-163081, paragraph 0041 can be used.

In addition, when it is used for the purpose of curing by heating or light-exposure to improve the strength, polymers having an ethylenically unsaturated bond in the molecule are preferably used.

As such polymers, examples of polymers comprising an ethylenically unsaturated bond in a main chain include SB (polystyrene-polybutadiene), SBS (polystyrene-polybutadiene-polystyrene), SIS (polystyrene-polyisoprene-polystyrene), SEBS (polystyrene-polyethylene/polybutylene-polystyrene), etc.

Polymers having an ethylenically unsaturated bond in a side chain are obtained by introducing an ethylenically unsaturated group such as an allyl group, an acryloyl group, a methacryloyl group, a styryl group, a vinyl ether group or the like into the side chain of the skeleton of a binder polymer described later. As the method for introducing an ethylenically unsaturated group into the side chain of the binder polymer, known methods may be employed, such as (1) a method in which a structural unit having a polymerizable group precursor formed by linking a protective group to a polymerizable group is copolymerized with a polymer, and the protective group is removed to form the polymerizable group, (2) a method in which a polymeric compound having plural reactive groups such as a hydroxyl group, an amino group, an epoxy group, a carboxylic group or the like is produced, and a compound having a group reacting with these reactive groups and an ethylenically unsaturated group is introduced by a polymer reaction, etc. According to these methods, the amount of an ethylenically unsaturated group to be introduced into the polymer compound can be controlled.

The binder polymer is preferably a binder polymer having a functional group capable of reacting with a hydroxyl group, hydrolyzable silyl group and/or a silanol group.

When the resin composition of the present invention comprises (Component B-1), the resin composition of the present invention preferably comprises the binder polymer having a reactive functional group, and more preferably a hydroxyl group.

The reactive functional group may be present in any part of the polymer molecule, but preferably lies on the side chain of the chain polymer. Preferred examples of such polymers include vinyl copolymers (copolymers of vinyl monomers such as polyvinyl alcohol and polyvinyl acetal, and derivatives thereof) and acrylic resins (copolymers of acrylic monomers such as hydroxyethyl(meth)acrylate, and derivatives thereof).

The method for introducing the reactive functional group into the binder polymer is not particularly limited, and includes a method of addition (co)polymerizing or polycondensing a monomer having the reactive functional group, and a method of synthesizing a polymer having a group inducible to the reactive functional group and inducing the polymer to the reactive functional group by a polymer reaction.

As Component J, in particular, (Component J-1) a binder polymer having a hydroxyl group is preferably used. It is explained below.

(Component J-1) Binder Polymer Having a Hydroxyl Group

Hereinafter, as the binder polymer in the resin composition of the present invention, (Component J-1) a binder polymer having a hydroxyl group (hereinafter, if necessary, also referred to as "specific polymer") is preferable. The specific polymer is preferably insoluble in water and soluble in alcohol having 1 to 4 carbon atoms.

As Component J-1 for the resin composition for laser engraving that gives a relief-forming layer satisfying both good suitability for an aqueous ink and for a UV ink, and having a high engraving sensitivity and good film performance, polyvinyl acetal and derivatives thereof, acrylic resins having a hydroxyl group on a side chain, epoxy resins having a hydroxyl group on a side chain, etc. are preferably cited.

Component J-1 preferably has a glass transition temperature (Tg) of at least 20° C. It is particularly preferable that it has a glass transition temperature (Tg) of at least 20° C. when combined with (Component D) a photothermal conversion agent capable of absorbing light having a wavelength of 700 to 1,300 nm, an optional component, from the viewpoint of improving a engraving sensitivity. A polymer having a glass transition temperature of at least 20° C. is also called a 'non-elastomer' below. The upper limit for the glass transition temperature of the polymer is not limited, but is preferably no greater than 200° C. from the viewpoint of ease of handling, and is more preferably at least 25° C. but no greater than 120° C.

When a polymer having a glass transition temperature of 20° C. (room temperature) or greater is used, a specific polymer is in a glass state at normal temperature. Because of this, compared with a case of the rubber state, thermal molecular motion is suppressed. In laser engraving, in addition to the heat given by a laser during laser irradiation, heat generated by the function of (Component D) a photothermal conversion agent added as desired is transmitted to the surrounding specific polymer, and this polymer is thermally decomposed and disappears, thereby forming an engraved recess.

When a specific polymer is used, it is surmised that when a photothermal conversion agent is present in a state in which thermal molecular motion of a specific polymer is suppressed, heat transfer to and thermal decomposition of the specific polymer occur effectively. It is anticipated that such an effect further increases the engraving sensitivity.

Specific examples of polymers that are non-elastomer for use preferably in the present invention are cited below.

(1) Polyvinyl Acetal and its Derivative

Polyvinyl acetal is a compound obtained by converting polyvinyl alcohol (obtained by saponifying polyvinyl acetate) into a cyclic acetal. The polyvinyl acetal derivative is a derivative obtained by modifying the polyvinyl acetal or adding another copolymer constituent.

The acetal content in the polyvinyl acetal derivative (mole % of vinyl alcohol units converted into acetal relative to the total number of moles of vinyl acetate monomer starting material as 100 mole %) is preferably 30 to 90 mole %, more preferably 50 to 85 mole %, and particularly preferably 55 to 78 mole %.

The vinyl alcohol unit in the polyvinyl acetal is preferably 10 to 70 mole % relative to the total number of moles of the vinyl acetate monomer starting material, more preferably 15 to 50 mole %, and particularly preferably 22 to 45 mole %.

Furthermore, the polyvinyl acetal may have a vinyl acetate unit as another component, and the content thereof is preferably 0.01 to 20 mole %, and more preferably 0.1 to 10 mole %. The polyvinyl acetal derivative may further have another copolymerized constitutional unit.

Examples of the polyvinyl acetal include polyvinyl butyral, polyvinyl propylal, polyvinyl ethylal, and polyvinyl methylal. Among them, polyvinyl butyral derivative (PVB) is particularly preferably used.

Polyvinyl butyral is conventionally obtained by converting polyvinyl alcohol into polyvinyl bytyral. Polyvinyl butyral derivatives may be also used.

Examples of the polyvinyl butyral derivatives include an acid-modified PVB in which at least some of the hydroxy groups are modified with an acid group such as a carboxy group, a modified PVB in which some of the hydroxy groups are modified with a (meth)acryloyl group, a modified PVB in which at least some of the hydroxy groups are modified with an amino group, a modified PVB in which at least some of the hydroxy groups have introduced thereinto ethylene glycol, propylene glycol, or a multimer thereof.

From the viewpoint of a balance being achieved between engraving sensitivity and film formation properties, the weight-average molecular weight of the polyvinyl acetal is preferably 5,000 to 800,000, more preferably 8,000 to 500,000 and, from the viewpoint of improvement of rinsing properties for engraved residue, particularly preferably 50,000 to 300,000.

Hereinafter, polyvinyl butyral (PVB) and derivatives thereof are cited for explanation as particularly preferred examples of polyvinyl acetal, but the acetal are not limited to these.

Polyvinyl butyral has a structure as shown below, and is constituted while including these structural units.

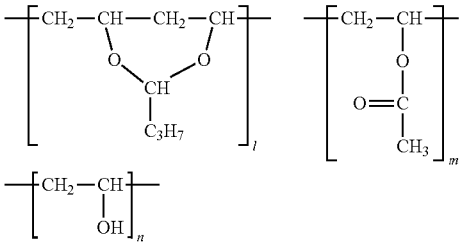

In the above Formula, l, m, and n denote the content (mole %) in polyvinyl butyral of the respective repeating units and the relationship l+m+n=100 is satisfied. The butyral content in the polyvinyl butyral and the derivative thereof (value of l in the formula above) is preferably 30 to 90 mole %, more preferably 40 to 85 mole %, and particularly preferably 45 to 78 mole %.

From the viewpoint of a balance being achieved between engraving sensitivity and film formation properties, the weight-average molecular weight of the polyvinyl butyral and the derivative thereof is preferably 5,000 to 800,000, more preferably 8,000 to 500,000 and, from the viewpoint of improvement of rinsing properties for engraved residue, particularly preferably 50,000 to 300,000.

The PVB derivative is also available as a commercial product, and preferred examples thereof include, from the viewpoint of alcohol dissolving capability (particularly, ethanol), "S-REC B" series and "S-REC K (KS)" series manufactured by SEKISUI CHEMICAL CO., LTD. and "DENKA BUTYRAL" manufactured by DENKI KAGAKU KOGYO KABUSHIKI KAISHA. From the viewpoint of alcohol dissolving capability (particularly, ethanol), "S-REC B" series manufactured by SEKISUI CHEMICAL CO., LTD. and "DENKA BUTYRAL" manufactured by DENKI KAGAKU KOGYO KABUSHIKI KAISHA are more preferable. Among these, particularly preferable commercial products are shown below along with the values l, m, and n in the above formulae and the molar weight. Examples of "S-REC B" series manufactured by SEKISUI CHEMICAL CO., LTD. include "BL-1" (l=61, m=3, n=36, weight-average molecular weight: 19,000), "BL-1H" (l=67, m=3, n=30, weight-average molecular weight: 20,000), "BL-2" (l=61, m=3, n=36, weight-average molecular weight: about 27,000), "BL-5" (l=75, m=4, n=21, weight-average molecular weight: 32,000), "BL-S" (l=74, m=4, n=22, weight-average molecular weight: 23,000), "BM-S" (l=73, m=5, n=22, weight-average molecular weight: 53,000), and "BH-S" (l=73, m=5, n=22, weight-average molecular weight: 66,000), and examples of "DENKA BUTYRAL" manufactured by DENKI KAGAKU KOGYO include "#3000-1" (l=71, m=1, n=28, weight-average molecular weight: 74,000), "#3000-2" (l=71, m=1, n=28, weight-average molecular weight: 90,000), "#3000-4" (l=71, m=1, n=28, weight-average molecular weight: 117,000), "#4000-2" (l=71, m=1, n=28, weight-average molecular weight: 152,000), "#6000-C" (l=64, m=1, n=35, weight-average molecular weight: 308,000), "#6000-EP" (l=56, m=15, n=29, weight-average molecular weight: 381,000), "#6000-CS" (l=74, m=1, n=25, weight-average molecular weight: 322,000), and "#6000-AS" (l=73, m=1, n=26, weight-average molecular weight: 242,000).

When the relief-forming layer is formed using the PVB derivative as a specific polymer, a method of casting and drying a solution in which a solvent is dissolved is preferable from the viewpoint of smoothness of the film surface.

(2) An Acrylic Resin

As an acrylic resin usable as a special polymer an acrylic resin may be used which can be synthesized from an acrylic monomer having a hydroxy group in the monomer.

Preferred examples of the acrylic monomer having a hydroxy group are a (meth)acrylic acid ester, a crotonic acid ester, or a (meth)acrylamide that has a hydroxy group in the molecule. Specific examples of such a monomer include 2-hydroxyethyl(meth)acrylate, 2-hydroxypropyl(meth)acrylate, and 4-hydroxybutyl(meth)acrylate.

In the present invention '(meth)acryl' means 'acryl' and/or 'methacryl' and '(meth)acrylate' means 'acrylate' and/or 'methacrylate.'

The acrylic resin may be constituted from a known acrylic comonomer other than the acrylic monomer having a hydroxy group explained above. As the known (meth)acrylic comonomer, the (meth)acrylic monomer can be cited, and specific examples thereof include methyl(meth)acrylate, ethyl(meth)acrylate, n-propyl(meth)acrylate, isopropyl(meth)acrylate, n-butyl(meth)acrylate, isobutyl(meth)acrylate, tert-butyl(meth)acrylate, n-hexyl(meth)acrylate, lauryl(meth)acrylate, 2-ethylhexyl(meth)acrylate, acetoxyethyl(meth)acrylate, phenyl(meth)acrylate, 2-methoxyethyl(meth)acrylate, 2-ethoxyethyl(meth)acrylate, 2-(2-methoxyethoxy)ethyl(meth)acrylate, cyclohexyl(meth)acrylate, t-butylcyclohexyl(meth)acrylate, benzyl(meth)acrylate, diethylene glycol monomethyl ether(meth)acrylate, diethylene glycol monoethyl ether(meth)acrylate, diethylene glycol monophenyl ether(meth)acrylate, triethylene glycol monomethyl ether(meth)acrylate, triethylene glycol monoethyl ether(meth)acrylate, dipropylene glycol monomethyl ether(meth)acrylate, polyethylene glycol monomethyl ether(meth)acrylate, polypropylene glycol monomethyl ether(meth)acrylate, the monomethyl ether(meth)acrylate of a copolymer of ethylene glycol and propylene glycol, N,N-dimethylaminoethyl(meth)acrylate, N,N-diethylaminoethyl(meth)acrylate, and N,N-dimethylaminopropyl(meth)acrylate.

Furthermore, a modified acrylic resin formed with a urethane group- or urea group-containing acrylic monomer may preferably be used.

Among these, from the viewpoint of aqueous ink resistance, an alkyl(meth)acrylate such as lauryl(meth)acrylate and an aliphatic cyclic structure-containing (meth)acrylate such as t-butylcyclohexyl(meth)acrylate are particularly preferable.

(3) A Novolac Resin

Furthermore, as the specific polymer, a novolac resin may be used, this being a resin formed by condensation of a phenol and an aldehyde under acidic conditions.

Preferred examples of the novolac resin include a novolac resin obtained from phenol and formaldehyde, a novolac resin obtained from m-cresol and formaldehyde, a novolac resin obtained from p-cresol and formaldehyde, a novolac resin obtained from o-cresol and formaldehyde, a novolac resin obtained from octylphenol and formaldehyde, a novolac resin obtained from mixed m-/p-cresol and formaldehyde, and a novolac resin between a mixture of phenol/cresol (any of m-, p-, o- or m-/p-, m-/o-, o-/p-mixtures) and formaldehyde.

With regard to these novolac resins, those having a weight-average molecular weight of 800 to 200,000 and a number-average molecular weight of 400 to 60,000 are preferable.

An epoxy resin having a hydroxy group in a side chain may be used as a specific polymer. A preferred example of the epoxy resin is an epoxy resin formed by polymerization, as a starting material monomer, of an adduct of bisphenol A and epichlorohydrin. The epoxy resin preferably has a weight-average molecular weight of 800 to 200,000, and a number-average molecular weight of 400 to 60,000.

Among specific polymers, polyvinyl butyral derivatives are particularly preferable from the viewpoint of rinsing properties and printing durability when the polymer is formed into the relief-forming layer.

In polymers of any embodiment described above, the content of the hydroxyl group contained in the specific polymer in the present invention is preferably 0.1 to 15 mmol/g, and more preferably 0.5 to 7 mmol/g.

For the resin composition for laser engraving, a known polymer not included in the specific polymer such as a polymer having no hydroxyl group may be used alone or in combination. Hereinafter, such polymer is also referred to as a common polymer.

The common polymer may be selected from a polystyrene resin, polyester resin, polyamide resin, polyureapolyamide-imide resin, polyurethane resin, polysulfone resin, polyether sulfone resin, polyimide resin, polycarbonate resin, hydroxyethylene unit-containing hydrophilic polymer, acrylic resin, acetal resin, polycarbonate resin, rubber, thermoplastic elastomer, etc.

For example, from the viewpoint of the laser engraving sensitivity, polymers having a partial structure capable of being thermally decomposed by exposure or heating are preferable. Examples of such polymers preferably include those described in JP-A-2008-163081, paragraph 0038. Moreover, for example, when the purpose is to form a film having softness and flexibility, a soft resin or a thermoplastic elastomer is selected. It is described in detail in JP-A-2008-163081, paragraphs 0039 to 0040. Furthermore, from the viewpoint of easy preparation of the composition for the relief-forming layer, and the improvement of resistance properties for an oil-based ink in the obtained relief printing plate, the use of a hydrophilic or alcoholphilic polymer is preferable. As the hydrophilic polymer, those described in detail in JP-A-2008-163081, paragraph 0041 can be used.

With regard to Component J in the resin composition for laser engraving of the present invention, one type may be used on its own, or two or more types may be used in combination.

(Component K) Solvent

The resin composition for laser engraving of the present invention may comprise (Component K) a solvent.

From the viewpoint of dissolving, a solvent used when preparing the resin composition for laser engraving of the present invention is preferably mainly an aprotic organic solvent. The aprotic organic solvent may be used on its own or may be used in combination with a protic organic solvent. More specifically, they are used preferably at aprotic organic solvent/protic organic solvent=100/0 to 50/50 (ratio by weight), more preferably 100/0 to 70/30, and particularly preferably 100/0 to 90/10.

Specific preferred examples of the aprotic organic solvent include acetonitrile, tetrahydrofuran, dioxane, toluene, propylene glycol monomethyl ether acetate, methyl ethyl ketone, acetone, methyl isobutyl ketone, ethyl acetate, butyl acetate, ethyl lactate, N,N-dimethylacetamide, N-methylpyrrolidone, and dimethyl sulfoxide.

Specific preferred examples of the protic organic solvent include methanol, ethanol, 1-propanol, 2-propanol, 1-butanol, 1-methoxy-2-propanol, ethylene glycol, diethylene glycol, and 1,3-propanediol.

Among these, propylene glycol monomethyl ether acetate is preferable.

<Other Additives>

The resin composition for laser engraving of the present invention may comprise as appropriate various types of known additives other than Component A to Component K as long as the effects of the present invention are not inhibited. Examples include a wax, a process oil, a metal oxide, an antiozonant, an anti-aging agent, a thermopolymerization inhibitor, a colorant, a fragrance, and an alcohol exchange catalyst, and one type thereof may be used on its own or two more types may be used in combination.

In the resin composition for laser engraving of the present invention, as an additive for improving engraving sensitivity, it is preferable that a nitrocellulose or highly heat-conductive material be added.

The nitrocellulose is a self-reactive compound, during laser engraving, the nitrocellulose itself generates heat to assist the thermal decomposition of the binder polymer such as a coexisting hydrophilic polymer. As a result, it is assumed that engraving sensitivity is improved.

The highly heat-conductive material is added for the purpose of assisting heat conduction, and examples of the heat-conductive material include an inorganic compound such as metal particles and an organic compound such as a conductive polymer. As the metal particles, small gold particles, small silver particles, and small copper particles having a particle size in the order of micrometers to several nanometers are preferable. As the conductive polymer, a conjugated polymer is particularly preferable, and specific examples thereof include polyaniline and polythiophene.

In addition, by using a co-sensitizer, the sensitivity when the resin composition for laser engraving is cured by light is further improved.

Further, during the production and preservation of composition, it is preferable that a small amount of thermal polymerization inhibitor be added for preventing unnecessary thermal polymerization of the polymerizable compound.

For the purpose of coloring the resin composition for laser engraving, colorant such as dye or pigment may be added. Accordingly, properties such as visibility of the image section and aptitude for an image density measuring machine can be improved.

(Relief Printing Plate Precursor for Laser Engraving)

A first embodiment of the relief printing plate precursor for laser engraving of the present invention comprises a relief-forming layer formed from the resin composition for laser engraving of the present invention.

A second embodiment of the relief printing plate precursor for laser engraving of the present invention comprises a crosslinked relief-forming layer formed by crosslinking a relief-forming layer formed from the resin composition for laser engraving of the present invention.

In the present invention, the 'relief printing plate precursor for laser engraving' means both or one of a relief printing plate precursor having a crosslinkable relief-forming layer formed from the resin composition for laser engraving in a state before being crosslinked and a relief printing plate precursor in a state in which it is cured by light or heat.

In the present invention, the 'relief-forming layer' means a layer in a state before being crosslinked, that is, a layer formed from the resin composition for laser engraving of the present invention, which may be dried as necessary.

In the present invention, the "crosslinked relief-forming layer" refers to a layer obtained by crosslinking the aforementioned relief-forming layer. The crosslinking can be performed by light and/or heat, and the crosslinking by heat is preferable. Moreover, the crosslinking is not particularly limited only if it is a reaction that cures the resin composition, and is a general idea that includes the crosslinked structure by the reaction of Component B with each other, the reaction of Component B with other Component.

The 'relief printing plate' is made by laser engraving the relief printing plate precursor having the crosslinked relief-forming layer.

Moreover, in the present invention, the 'relief layer' means a layer of the relief printing plate formed by engraving using a laser, that is, the crosslinked relief-forming layer after laser engraving.

A relief printing plate precursor for laser engraving of the present invention comprises a relief-forming layer formed from the resin composition for laser engraving of the present invention, which has the above-mentioned components. The (crosslinked) relief-forming layer is preferably provided above a support.

The (crosslinked) relief printing plate precursor for laser engraving may further comprise, as necessary, an adhesive layer between the support and the (crosslinked) relief-forming layer and, above the relief-forming layer, a slip coat layer and a protection film.

<Relief-Forming Layer>

The relief-forming layer is a layer formed from the resin composition for laser engraving of the present invention, and is preferably crosslinkable by heat.

As a mode in which a relief printing plate is prepared using the relief printing plate precursor for laser engraving, a mode in which a relief printing plate is prepared by crosslinking a relief-forming layer to thus form a relief printing plate precursor having a crosslinked relief-forming layer, and the crosslinked relief-forming layer (hard relief-forming layer) is then laser-engraved to thus form a relief layer is preferable. By crosslinking the relief-forming layer, it is possible to prevent abrasion of the relief layer during printing, and it is possible to obtain a relief printing plate having a relief layer with a sharp shape after laser engraving.

The relief-forming layer may be formed by molding the resin composition for laser engraving that has the above-mentioned components for a relief-forming layer into a sheet shape or a sleeve shape. The relief-forming layer is usually provided above a support, which is described later, but it may be formed directly on the surface of a member such as a cylinder of equipment for plate producing or printing or may be placed and immobilized thereon, and a support is not always required.

A case in which the relief-forming layer is mainly formed in a sheet shape is explained as an Example below.

<Support>

A material used for the support of the relief printing plate precursor for laser engraving is not particularly limited, but one having high dimensional stability is preferably used, and examples thereof include metals such as steel, stainless steel, or aluminum, plastic resins such as a polyester (e.g. polyethylene terephthalate (PET), polybutylene terephthalate (PBT), or polyacrylonitrile (PAN)) or polyvinyl chloride, synthetic rubbers such as styrene-butadiene rubber, and glass fiber-reinforced plastic resins (epoxy resin, phenolic resin, etc.). As the support, a PET film or a steel substrate is preferably used. The configuration of the support depends on whether the relief-forming layer is in a sheet shape or a sleeve shape.

<Adhesive Layer>

An adhesive layer may be provided between the relief-forming layer and the support for the purpose of strengthening the adhesion between the two layers. Examples of materials (adhesives) that can be used in the adhesive layer include those described in 'Handbook of Adhesives', Second Edition, Ed by I. Skeist, (1977).

<Protection Film, Slip Coat Layer>

For the purpose of preventing scratches or dents in the relief-forming layer surface or the crosslinked relief-forming layer surface, a protection film may be provided on the relief-forming layer surface or the crosslinked relief-forming layer surface. The thickness of the protection film is preferably 25 to 500 μm, and more preferably 50 to 200 μm. The protection film may employ, for example, a polyester-based film such as PET or a polyolefin-based film such as PE (polyethylene) or PP (polypropylene). The surface of the film may be made matte. The protection film is preferably peelable.

When the protection film is not peelable or conversely has poor adhesion to the relief-forming layer, a slip coat layer may be provided between the two layers. The material used in the slip coat layer preferably employs as a main component a resin that is soluble or dispersible in water and has little tackiness, such as polyvinyl alcohol, polyvinyl acetate, partially saponified polyvinyl alcohol, a hydroxyalkylcellulose, an alkylcellulose, or a polyamide resin.

<Process for Producing Relief Printing Plate Precursor for Laser Engraving>

The process for producing a relief printing plate precursor for laser engraving is not particularly limited, and examples thereof include a method in which a resin composition for laser engraving is prepared, solvent is removed from this coating solution composition for laser engraving, and it is then melt-extruded onto a support. Alternatively, a method may be employed in which a resin composition for laser engraving is cast onto a support, and this is dried in an oven to thus remove solvent from the resin composition.

Among them, the process for producing a relief printing plate precursor for laser engraving of the present invention is preferably a production process comprising a layer formation step of forming a relief-forming layer from the resin composition for laser engraving of the present invention and a crosslinking step of crosslinking the relief-forming layer by means of heat and/or light to thus obtain a relief printing plate precursor having a crosslinked relief-forming layer.

Subsequently, as necessary, a protection film may be laminated on the relief-forming layer. Laminating may be carried out by compression-bonding the protection film and the relief-forming layer by means of heated calendar rollers, etc. or putting a protection film into intimate contact with a relief-forming layer whose surface is impregnated with a small amount of solvent.

When a protection film is used, a method in which a relief-forming layer is first layered on a protection film and a support is then laminated may be employed.

When an adhesive layer is provided, it may be dealt with by use of a support coated with an adhesive layer. When a slip coat layer is provided, it may be dealt with by use of a protection film coated with a slip coat layer.

<Layer Formation Step>

The process for producing the relief printing plate precursor for laser engraving of the present invention preferably comprises a layer formation step of forming a relief-forming layer from the resin composition for laser engraving of the present invention.

Preferred examples of a method for forming the relief-forming layer include a method in which the resin composition for laser engraving of the present invention is prepared, solvent is removed as necessary from this resin composition for laser engraving, and it is then melt-extruded onto a support and a method in which the resin composition for laser engraving of the present invention is prepared, the resin composition for laser engraving of the present invention is cast onto a support, and this is dried in an oven to thus remove solvent.

The resin composition for laser engraving may be produced by, for example, dissolving or dispersing Components A and B, and as optional components, Component C to Component J in an appropriate solvent, and then mixing these solutions. It is necessary to remove most of the solvent component in a stage of producing a relief printing plate precursor. It is preferable to use as the solvent a volatile one such as low molecular weight alcohol (for example, methanol, ethanol, n-propanol, isopropanol, propylene glycol monomethylether) and adjust the temperature, etc. to thus reduce as much as possible the total amount of solvent to be added.

The thickness of the (crosslinked) relief-forming layer in the relief printing plate precursor for laser engraving is preferably 0.05 to 10 mm before and after crosslinking, more preferably 0.05 to 7 mm, and yet more preferably 0.05 to 3 mm.

<Crosslinking Step>

The process for producing a relief printing plate precursor for laser engraving of the present invention is preferably a production process comprising a crosslinking step of crosslinking the relief-forming layer by means of heat to thus obtain a relief printing plate precursor having a crosslinked relief-forming layer.

The relief-forming layer may be crosslinked by heating the relief printing plate precursor for laser engraving (step of crosslinking by means of heat). As heating means for carrying out crosslinking by heat, there can be cited a method in which a printing plate precursor is heated in a hot air oven or a far-infrared oven for a predetermined period of time and a method in which it is put into contact with a heated roller for a predetermined period of time.

Due to the relief-forming layer being thermally crosslinked, firstly, a relief formed after laser engraving becomes sharp and, secondly, tackiness of engraved residue formed when laser engraving is suppressed.

In the present invention, during the crosslinking step, there is a polymerization reaction between Component A and Component B.

In addition, since by using a photopolymerization initiator or the like, the polymerizable compound is polymerized to form a crosslink, the crosslinking may be further carried out by means of light.

When the relief-forming layer comprises a photopolymerization initiator, the relief-forming layer may be crosslinked by irradiating the relief-forming layer with actinic radiation that triggers the photopolymerization initiator.

It is preferable to apply light to the entire surface of the relief-forming layer. Examples of the light (also called 'actinic radiation') include visible light, UV light, and an electron beam, but UV light is most preferably used. When the side where there is a substrate, such as a relief-forming layer support, for fixing the relief-forming layer, is defined as the reverse face, only the front face need to be irradiated with light, but when the support is a transparent film through which actinic radiation passes, it is preferable to further irradiate from the reverse face with light as well. When a protection film is present, irradiation from the front face may be carried out with the protection film as it is or after peeling off the protection film. Since there is a possibility of polymerization being inhibited in the presence of oxygen, irradiation with actinic radiation may be carried out after superimposing a polyvinyl chloride sheet on the relief-forming layer and evacuating.

(Relief Printing Plate and Process for Making Same)

The process for making a relief printing plate of the present invention comprises an engraving step of laser-engraving the relief printing plate precursor of the present invention. Furthermore, the process for making a relief printing plate of the present invention preferably comprises a layer formation step of forming a relief-forming layer from the resin composition for laser engraving of the present invention, a crosslinking step of crosslinking the relief-forming layer by means of heat to thus obtain a relief printing plate precursor having a crosslinked relief-forming layer, and an engraving step of laser-engraving the relief printing plate precursor having the crosslinked relief-forming layer.

The relief printing plate of the present invention is a relief printing plate having a relief layer obtained by crosslinking and laser-engraving a layer formed from the resin composition for laser engraving of the present invention, and is preferably a relief printing plate made by the process for producing a relief printing plate of the present invention.

The relief printing plate of the present invention may suitably employ an aqueous ink when printing.

The layer formation step and the crosslinking step in the process for producing a relief printing plate of the present invention mean the same as the layer formation step and the crosslinking step in the above-mentioned process for producing a relief printing plate precursor for laser engraving, and preferred ranges are also the same.

<Engraving Step>

The process for producing a relief printing plate of the present invention preferably comprises an engraving step of laser-engraving the relief printing plate precursor having a crosslinked relief-forming layer.

The engraving step is a step of laser-engraving a crosslinked relief-forming layer that has been crosslinked in the crosslinking step to thus form a relief layer. Specifically, it is preferable to engrave a crosslinked relief-forming layer that has been crosslinked with laser light according to a desired image, thus forming a relief layer. Furthermore, a step in which a crosslinked relief-forming layer is subjected to scanning irradiation by controlling a laser head using a computer in accordance with digital data of a desired image can preferably be cited.

This engraving step preferably employs an infrared laser. When irradiated with an infrared laser, molecules in the crosslinked relief-forming layer undergo molecular vibration, thus generating heat. When a high power laser such as a carbon dioxide laser or a YAG laser is used as the infrared laser, a large quantity of heat is generated in the laser-irradiated area, and molecules in the crosslinked relief-forming layer undergo molecular scission or ionization, thus being selectively removed, that is, engraved. The advantage of laser engraving is that, since the depth of engraving can be set freely, it is possible to control the structure three-dimensionally. For example, for an area where fine halftone dots are printed, carrying out engraving shallowly or with a shoulder prevents the relief from collapsing due to printing pressure, and for a groove area where a fine outline character is printed, carrying out engraving deeply makes it difficult for ink the groove to be blocked with ink, thus enabling breakup of an outline character to be suppressed.

In particular, when engraving is carried out using an infrared laser that corresponds to the absorption wavelength of the photothermal conversion agent, it becomes possible to selectively remove the crosslinked relief-forming layer at higher sensitivity, thus giving a relief layer having a sharp image.

As the infrared laser used in the engraving step, from the viewpoint of productivity, cost, etc., a carbon dioxide laser or a semiconductor laser is preferable. In particular, a fiber-coupled semiconductor infrared laser is preferably used. In general, compared with a $CO_2$ laser, a semiconductor laser has higher efficiency laser oscillation, is less expensive, and can be made smaller. Furthermore, it is easy to form an array due to the small size. Moreover, the shape of the beam can be controlled by treatment of the fiber.

With regard to the semiconductor laser, one having a wavelength of 700 to 1,300 nm is preferable, one having a wavelength of 800 to 1,200 nm is more preferable, one having a wavelength of 860 to 1,200 nm is yet more preferable, and one having a wavelength of 900 to 1,100 nm is particularly preferable.

Furthermore, the fiber-coupled semiconductor laser can output laser light efficiently by being equipped with optical fiber, and this is effective in the engraving step in the present invention. Moreover, the shape of the beam can be controlled by treatment of the fiber. For example, the beam profile may be a top hat shape, and energy can be applied stably to the plate face. Details of semiconductor lasers are described in 'Laser Handbook 2$^{nd}$ Edition' The Laser Society of Japan, Applied Laser Technology, The Institute of Electronics and Communication Engineers, etc.

Moreover, as plate making equipment comprising a fiber-coupled semiconductor laser that can be used suitably in the process for making a relief printing plate employing the relief printing plate precursor of the present invention, those described in detail in JP-A-2009-172658 and JP-A-2009-214334 can be cited. Such equipment comprising a fiber-coupled semiconductor laser can be used to produce a relief printing plate of the present invention.

The process for producing a relief printing plate of the present invention may as necessary further comprise, subsequent to the engraving step, a rinsing step, a drying step, and/or a post-crosslinking step, which are shown below.

Rinsing step: a step of rinsing the engraved surface by rinsing the engraved relief layer surface with water or a liquid comprising water as a main component.

Drying step: a step of drying the engraved relief layer.

Post-crosslinking step: a step of further crosslinking the relief layer by applying energy to the engraved relief layer.

After the above-mentioned step, since engraved residue is attached to the engraved surface, a rinsing step of washing off engraved residue by rinsing the engraved surface with water or a liquid comprising water as a main component may be added. Examples of rinsing means include a method in which washing is carried out with tap water, a method in which high pressure water is spray-jetted, and a method in which the engraved surface is brushed in the presence of mainly water using a batch or conveyor brush type washout machine known as a photosensitive resin letterpress plate processor, and when slime due to engraved residue cannot be eliminated, a rinsing liquid to which a soap or a surfactant is added may be used.

When the rinsing step of rinsing the engraved surface is carried out, it is preferable to add a drying step of drying an engraved relief-forming layer so as to evaporate rinsing liquid.

Furthermore, as necessary, a post-crosslinking step for further crosslinking the relief-forming layer may be added. By carrying out a post-crosslinking step, which is an additional crosslinking step, it is possible to further strengthen the relief formed by engraving.

The pH of the rinsing liquid that can be used in the present invention is preferably at least 9, more preferably at least 10, and yet more preferably at least 11. The pH of the rinsing liquid is preferably no greater than 14, more preferably no greater than 13.5, and yet more preferably no greater than 13.2, and especially preferably no greater than 13.0. When in the above-mentioned range, handling is easy.

In order to set the pH of the rinsing liquid in the above-mentioned range, the pH may be adjusted using an acid and/or a base as appropriate, and the acid or base used is not particularly limited.

The rinsing liquid that can be used in the present invention preferably comprises water as a main component.

The rinsing liquid may contain as a solvent other than water a water-miscible solvent such as an alcohol, acetone, or tetrahydrofuran.

The rinsing liquid preferably comprises a surfactant.

From the viewpoint of removability of engraved residue and little influence on a relief printing plate, preferred examples of the surfactant that can be used in the present invention include betaine compounds (amphoteric surfactants) such as a carboxybetaine compound, a sulfobetaine compound, a phosphobetaine compound, an amine oxide compound, and a phosphine oxide compound.

Furthermore, examples of the surfactant also include known anionic surfactants, cationic surfactants, and nonionic surfactants. Moreover, a fluorine-based or silicone-based nonionic surfactant may also be used in the same manner.

With regard to the surfactant, one type may be used on its own or two or more types may be used in combination.

It is not necessary to particularly limit the amount of surfactant used, but it is preferably 0.01 to 20 wt % relative to the total weight of the rinsing liquid, and more preferably 0.05 to 10 wt %.

The relief printing plate of the present invention having a relief layer above the surface of an optional substrate such as a support may be produced as described above.

From the viewpoint of satisfying suitability for various aspects of printing, such as abrasion resistance and ink transfer properties, the thickness of the relief layer of the relief printing plate is preferably at least 0.05 mm but no greater than 10 mm, more preferably at least 0.05 mm but no greater than 7 mm, and yet more preferably at least 0.05 mm but no greater than 0.3 mm.

Furthermore, the Shore A hardness of the relief layer of the relief printing plate is preferably at least 50° but no greater than 90°. When the Shore A hardness of the relief layer is at least 50°, even if fine halftone dots formed by engraving receive a strong printing pressure from a letterpress printer, they do not collapse and close up, and normal printing can be carried out. Furthermore, when the Shore A hardness of the relief layer is no greater than 90°, even for flexographic printing with kiss touch printing pressure it is possible to prevent patchy printing in a solid printed part.

The Shore A hardness in the present specification is a value measured by a durometer (a spring type rubber hardness meter) that presses an indenter (called a pressing needle or indenter) into the surface of a measurement target at 25° C. so as to deform it, measures the amount of deformation (indentation depth), and converts it into a numerical value.

The relief printing plate of the present invention is particularly suitable for printing by a flexographic printer using an aqueous ink, but printing is also possible when it is carried out by a letterpress printer using any of aqueous, oil-based, and UV inks, and printing is also possible when it is carried out by a flexographic printer using a UV ink. The relief printing plate of the present invention has excellent rinsing properties, there is no engraved residue, and has excellent printing durability, and printing can be carried out for a long period of time without plastic deformation of the relief layer or degradation of printing durability.

By the process for producing a relief printing plate precursor for laser engraving of the present invention, a relief printing plate precursor having excellent rinsing properties and engraving sensitivity was provided. Furthermore, by the process for making a relief printing plate of the present invention, a relief printing plate having excellent suitability to solvent inks and excellent printing durability was provided.

EXAMPLES

The present invention is explained in further detail below by reference to Examples, but the present invention should not be construed as being limited to these Examples.

The weight-average molecular weight (Mw) of a polymer in the Examples is a value measured by a GPC method (eluent: tetrahydrofurane) unless otherwise specified. Furthermore, 'parts' in the description below means 'parts by weight' unless otherwise specified.

Details of components used in Examples and Comparative Examples are as follows.

(Component A)

Duranate TPA-100: Hexamethylene diisocyanate non-yellowing type polyisocyanate (isocyanurate type) (manufactured by Asahi Kasei Chemicals Corp., number average molecular weight: 600, weight % of isocyanato groups: 23 wt %, average number of isocyanato groups, fn: 3.3)

Duranate TKA-100: Hexamethylene diisocyanate non-yellowing type polyisocyanate (isocyanurate type) (manufactured by Asahi Kasei Chemicals Corp., number average molecular weight: 660, weight % of isocyanato groups: 21.7 wt %, average number of isocyanato groups, fn: 3.4)

Duranate TLA-100: Hexamethylene diisocyanate non-yellowing type polyisocyanate (isocyanurate type) (manufactured by Asahi Kasei Chemicals Corp., number average molecular weight: 540, weight % of isocyanato groups: 23.4 wt %, average number of isocyanato groups, fn: 3.0)

Duranate TSE-100: Hexamethylene diisocyanate non-yellowing type polyisocyanate (isocyanurate type) (manufactured by Asahi Kasei Chemicals Corp., number average molecular weight: 860, weight % of isocyanato groups: 12.2 wt %, average number of isocyanato groups, fn: 2.5)

Duranate TSA-100: Hexamethylene diisocyanate non-yellowing type polyisocyanate (isocyanurate type) (manufactured by Asahi Kasei Chemicals Corp., number average molecular weight: 560, weight % of isocyanato groups: 20.7 wt %, average number of isocyanato groups, fn: 2.8)

Duranate TSS-100: Hexamethylene diisocyanate non-yellowing type polyisocyanate (isocyanurate type) (manufactured by Asahi Kasei Chemicals Corp., number average molecular weight: 610, weight % of isocyanato groups: 17.8 wt %, average number of isocyanato groups, fn: 2.6)

Duranate TSR-100: Hexamethylene diisocyanate non-yellowing type polyisocyanate (isocyanurate type) (manufactured by Asahi Kasei Chemicals Corp., number average molecular weight: 520, weight % of isocyanato groups: 20.4 wt %, average number of isocyanato groups, fn: 2.5)

Duranate 24A-100: Hexamethylene diisocyanate non-yellowing type polyisocyanate (biuret type) (manufactured by Asahi Kasei Chemicals Corp., number average molecular weight: 560, weight % of isocyanato groups: 23.5 wt %, average number of isocyanato groups, fn: 3.1)

(Component B)

KF-6003 (both terminal carbinol-modified silicone oil, manufactured by Shin-Etsu Chemical Co., Ltd.)

X-22-160AS (both terminal carbinol-modified silicone oil, manufactured by Shin-Etsu Chemical Co., Ltd.)

BY16-004 (both terminal carbinol-modified silicone oil, manufactured by Dow Corning Toray Co., Ltd.)

KF-8010 (both terminal amino-modified silicone oil, manufactured by Shin-Etsu Chemical Co., Ltd.)

X-22-161A (both terminal amino-modified silicone oil, manufactured by Shin-Etsu Chemical Co., Ltd.)

X-22-176DX (single terminal diol-modified silicone oil, manufactured by Shin-Etsu Chemical Co., Ltd.)

X-22-176F (single terminal diol-modified silicone oil, manufactured by Shin-Etsu Chemical Co., Ltd.)

X-22-176D (single terminal diol-modified silicone oil, manufactured by Shin-Etsu Chemical Co., Ltd.)

KF-96-10 (dimethylsilicone oil, manufactured by Shin-Etsu Chemical Co., Ltd.)

(Component C)

PCDL T4672 (Duranol T4672, polycarbonate diol, manufactured by Asahi Kasei Corp.)

Diethylene glycol (manufactured by Wako Pure Chemical Industries, Ltd.)

Trimethylolpropane (manufactured by Tokyo Chemical Industry Co., Ltd.)

(Component D)

Perbutyl Z (t-butylperoxybenzoate, NOF Corporation)

(Component E)

Diethylene glycol dimethacrylate (Tokyo Chemical Industry Co., Ltd.)

(Component F)

Carbon black #45L (manufactured by Mitsubishi Chemical Corp., particle size: 24 nm, specific surface area: 125 $m^2/g$, DBP oil absorption: 45 $cm^3/100$ g)

(Component G)

RS-540 (Adekasizer RS-540, manufactured by ADEKA Corp.)

(Component H)

KBE-846 (silane coupling agent, $(CH_3CH_2O)_3Si—(CH_2)_3—SSSS—(CH_2)_3—Si(OCH_2CH_3)_3$, manufactured by Shin-Etsu Chemical Co., Ltd.)

Examples 1 to 16 and Comparative Examples 1 to 4

1. Preparation of Resin Composition for Laser Engraving

A three-necked flask equipped with a stirring blade and a condenser was charged with 35 parts by weight of Component A shown in Table 1, 50 parts by weight of Component B shown in Table 1, 10 parts by weight of Component C shown in Table 1, 15 parts by weight of Component E shown in Table 1 and 10 parts by weight of Component G shown in Table 1, and heated at 70° C. for 30 minutes while stirring.

Subsequently, the temperature of the solution was set to 40° C. and 1 parts by weight of Component D shown in Table 1, 2 parts by weight of Component F shown in Table 1, and 5 parts by weight of Component H shown in Table 1 were added, and stirring was carried out for 30 minutes.

Subsequently, as a fragrance, 0.1% by weight of isobornyl acetate (manufactured by Wako Pure Chemical Industries, Ltd.) (relative to the total solid content of the resin composition) was added, and stirring was carried out for 10 minutes at 40° C.

As a result of the above operations, flowable coating solution for a crosslinkable relief-forming layer (resin composition for laser engraving) was obtained.

Meanwhile, when "none" is described in Table 1, the relevant component was not added to the coating solution described above (the weight proportion that was not added was supplemented by increasing the total amount of addition while maintaining the proportions of the amounts of addition of the other materials).

In Comparative Example 1, 85 parts by weight of following Resin A was added instead of Component A and Component B.

—Preparation of Resin A—

In a separable flask equipped with a thermometer, a stirrer and a circulator, 413.72 parts by weight of a both terminal carbinol-modified silicone oil manufactured by Shin-Etsu Chemical Co., Ltd., KF-6003 (number average molecular weight 5,100, OH value 22.0) and 11.05 parts by weight of tolylene diisocyanate were added, and the mixture was allowed to react for about 3 hours at a raised temperature of 80° C. Subsequently, 16.24 parts by weight of 2-methacryloyloxy isocyanate was added to the reaction mixture, and the resulting mixture was allowed to react for about 3 hours. Thus, Resin A having methacryl groups at the terminals (the number of polymerizable unsaturated groups in the molecule is about 2.0 per molecule on the average) and having a number average molecular weight of about 8,000 was prepared. This resin contained siloxane bonds in the main chain, was syrup-like at 20° C., and was flowable when an external force was applied. On the other hand, even if the external force was removed, the resin did not recover its original shape.

In Comparative Example 2, 85 parts by weight of following Resin B was added instead of Component A and Component B.

—Preparation of Resin B—

In a separable flask equipped with a thermometer, a stirrer and a circulator, 474.24 parts by weight of a single terminal diol-modified silicone oil manufactured by Shin-Etsu Chemical Co., Ltd., X-22-176DF (number average molecular weight 3,206, OH value 35.0) and 22.17 parts by weight of tolylene diisocyanate were added, and the mixture was allowed to react for about 3 hours at a raised temperature of 80° C. Subsequently, 6.42 parts by weight of 2-methacryloyloxy isocyanate was added to the reaction mixture, and the resulting mixture was allowed to react for about 3 hours. Thus, Resin B having methacryl groups at the terminals (the number of polymerizable unsaturated groups in the molecule is about 2.0 per molecule on the average) and having a number average molecular weight of about 24,000 was prepared. This resin contained siloxane bonds in the side chains, was syrup-like at 20° C., and was flowable when an external force was applied. On the other hand, even if the external force was removed, the resin did not recover its original shape.

TABLE 1

| | Component | | | | | | | |
|---|---|---|---|---|---|---|---|---|
| | A | B | C | D | E | F | G | H |
| Example 1 | Duranate TPA-100 | KF-6003 | None | None | None | None | None | None |
| Example 2 | Duranate TPA-100 | KF-6003 | None | None | None | Carbon black #45L | None | None |
| Example 3 | Duranate TKA-100 | X-22-160AS | None | None | None | Carbon black #45L | None | None |
| Example 4 | Duranate TLA-100 | BY16-004 | None | None | None | Carbon black #45L | None | None |
| Example 5 | Duranate 24A-100 | KF-8010 | None | None | None | Carbon black #45L | None | None |
| Example 6 | Duranate TSE-100 | X-22-161A | None | None | None | Carbon black #45L | None | None |
| Example 7 | Duranate TSA-100 | X-22-176DX | None | None | None | Carbon black #45L | None | None |
| Example 8 | Duranate TSS-100 | X-22-176F | None | None | None | Carbon black #45L | None | None |
| Example 9 | Duranate TSR-100 | X-22-176D | None | None | None | Carbon black #45L | None | None |
| Example 10 | Duranate TPA-100 | KF-6003 | PCDL T4672 | None | None | None | None | None |
| Example 11 | Duranate TPA-100 | KF-6003 | PCDL T4672 | None | None | Carbon black #45L | None | None |
| Example 12 | Duranate TPA-100 | KF-6003 | Diethylene glycol | Perbutyl Z | Diethylene glycol dimethacrylate | None | None | None |
| Example 13 | Duranate TPA-100 | KF-6003 | Diethylene glycol | Perbutyl Z | Diethylene glycol dimethacrylate | Carbon black #45L | RS-540 | None |
| Example 14 | Duranate TPA-100 | KF-6003 | Trimethylolpropane | Perbutyl Z | Diethylene glycol dimethacrylate | None | RS-540 | None |
| Example 15 | Duranate TPA-100 | KF-6003 | Trimethylolpropane | Perbutyl Z | Diethylene glycol dimethacrylate | Carbon black #45L | RS-540 | None |
| Example 16 | Duranate TPA-100 | KF-6003 | None | None | None | Carbon black #45L | None | KBE-846 |
| Comparative Example 1 | Resin A | | None | Perbutyl Z | Diethylene glycol dimethacrylate | Carbon black #45L | None | None |
| Comparative Example 2 | Resin B | | None | Perbutyl Z | Diethylene glycol dimethacrylate | Carbon black #45L | None | None |
| Comparative Example 3 | Duranate TPA-100 | None | Diethylene glycol | Perbutyl Z | Diethylene glycol dimethacrylate | None | None | None |
| Comparative Example 4 | Duranate TPA-100 | KF-96-10 | None | None | None | None | None | None |

2. Preparation of Relief Printing Plate Precursor for Laser Engraving

A spacer (frame) having a predetermined thickness was placed on a PET substrate, and each coating solution for a relief-forming layer obtained above was cast gently so that it did not overflow from the spacer (frame) and dried in an oven at 90° C. to provide a relief-forming layer having a thickness of about 1 mm, thus preparing the relief printing plate precursor for laser engraving.

At this time, the relief printing plate precursor for laser engraving was heated in an oven at 90° C. until the stickiness of the surface completely disappeared, and thereby thermal crosslinking was carried out.

3. Making Relief Printing Plate

The relief-forming layer after crosslinking was engraved using the two types of laser below.

As a carbon dioxide laser engraving machine, for engraving by irradiation with a laser, an ML-9100 series high quality $CO_2$ laser marker (Keyence) was used. After a protection film was peeled off from the printing plate precursor for laser engraving 1, a 1 cm square solid printed part was raster-engraved using the carbon dioxide laser engraving machine under conditions of an output of 12 W, a head speed of 200 mm/sec, and a pitch setting of 2,400 DPI.

As a semiconductor laser engraving machine, laser recording equipment provided with an SDL-6390 fiber-coupled semiconductor laser (FC-LD) (JDSU, wavelength 915 nm) with a maximum power of 8.0 W was used. A 1 cm square solid printed part was raster-engraved using the semiconductor laser engraving machine under conditions of a laser output of 7.5 W, a head speed of 409 mm/sec, and a pitch setting of 2,400 DPI.

The thickness of the relief layer of each relief printing plate obtained in Examples 1 to 16 and Comparative Examples 1 to 4 was about 1 mm.

Furthermore, when the Shore A hardness of the relief layer was measured by the above-mentioned measurement method, it was found to be 75°.

4. Evaluation of Relief Printing Plate

The performance of a relief printing plate was evaluated for the items below. The results are shown in Table 2.

(4-1) Time Required for Production

The time taken from the point immediately after each of the resin composition for laser engraving was flow cast into the spacer to the point at which the stickiness of the surface completely disappeared in an oven at 90° C. (serving as an index for the completion of thermal crosslinking) was defined as the production time in Table 2.

(4-2) Rinsing Properties

A laser engraved plate was immersed in water and an engraved part was rubbed with a toothbrush (Clinica Toothbrush Flat, Lion Corporation) 10 times. Subsequently, the presence/absence of residue on the surface of the relief layer was checked by an optical microscope. When there was no residue, the evaluation was A, when there was hardly any residue the evaluation was B, when there was a little residue the evaluation was C, when there was some residue remaining but caused no problem in practice the evaluation was D, and when the residue could not be removed the evaluation was E.

(4-3) Ink Transferability

During the evaluation of printing durability described below, the degree of adherence of ink at the solid part on a printed matter at a paper length of 1,000 m from the initiation of printing were compared by visual inspection.

The evaluation criteria were that a printed matter having uniform density and slight gloss (the index of gloss means that an ink is reliably transferred to a certain thickness (amount)) without unevenness was rated as A, a printed matter having uniform density without unevenness was rated as B, a printed matter having unevenness was rated as D, and a printed matter in an intermediate state between B and D was rated as C.

(4-4) Printing Durability

The relief printing plate thus obtained was mounted on a printing machine (ITM-4 type, manufactured by Iyo Kikai Seisakusho Co., Ltd.), and printing was continuously carried out using an aqueous ink, Aqua SPZ16 Magenta (manufactured by Toyo Ink Manufacturing Co., Ltd.), as an undiluted ink, and using full-color Form M 70 (manufactured by Nippon Paper Group, Inc., thickness 100 μm) as a printing paper. Highlight grades 1% to 10% were checked in the print products. The occurrence of half-tones where printing was not achieved was considered as the completion of printing, and the length (meters) of paper that had been printed until the completion of printing was taken as an index. The evaluation was made such that a larger value indicated superior printing durability.

(4-5) Engraving Depth

"Engraving Depth" of the each of the relief layers which are obtained by laser engraving the relief-forming layer of the relief printing plate precursors 1 to 16 and C1 to C5 was measured as follows. Here, "engraving depth" indicates the difference between the engraved position (height) and the non-engraved position (height) in a case where the cross-section of the relief layer is observed. "Engraving depths" in the present examples were measured by observation using an ultra-depth color 3D profile measurement microscope VK9510 (manufactured by Keyence Corporation). The large engraving depth means a high engraving sensitivity. The results are shown in Table 2 with respect to a type of laser used for engraving.

TABLE 2

| | Time required for production (hr) | Rinsing properties | Ink transferability | Printing durability (m) | Engraving depth (μm) $CO_2$ laser | Engraving depth (μm) IR laser (FC-LD) |
|---|---|---|---|---|---|---|
| Example 1 | 4 | B | B | 100,000 | 340 | 0 |
| Example 2 | 4 | B | B | 100,000 | 355 | 462 |
| Example 3 | 4 | B | B | 100,000 | 360 | 468 |
| Example 4 | 4 | B | B | 100,000 | 350 | 455 |
| Example 5 | 4 | B | B | 100,000 | 365 | 475 |
| Example 6 | 4 | B | B | 110,000 | 345 | 445 |
| Example 7 | 4 | B | B | 120,000 | 345 | 450 |
| Example 8 | 4 | B | B | 110,000 | 345 | 450 |
| Example 9 | 4 | B | B | 120,000 | 345 | 449 |
| Example 10 | 4 | B | B | 120,000 | 340 | 0 |
| Example 11 | 4 | B | B | 160,000 | 350 | 450 |
| Example 12 | 3.5 | B | B | 100,000 | 350 | 0 |
| Example 13 | 3 | B | B | 100,000 | 360 | 470 |
| Example 14 | 3 | B | B | 100,000 | 355 | 0 |
| Example 15 | 3 | B | B | 120,000 | 360 | 475 |
| Example 16 | 3 | A | A | 120,000 | 390 | 480 |
| Comparative Example 1 | 10 | D | C | 80,000 | 320 | 420 |
| Comparative Example 2 | 9 | D | C | 80,000 | 320 | 420 |
| Comparative Example 3 | 4 | E | D | 60,000 | 315 | 0 |
| Comparative Example 4 | 4 | E | D | 50,000 | 290 | 0 |

What is claimed is:

1. A process for producing a relief printing plate precursor for laser engraving, the process comprising:

a layer forming step of forming a relief-forming layer formed from a resin composition for laser engraving containing (Component A) an isocyanate compound having an average number of isocyanato groups, fn, of greater than 2, and (Component B) a compound having a siloxane bond in the molecule and having two or more active hydrogen atoms; and a crosslinking step of thermally crosslinking the relief-forming layer, and thereby obtaining a relief printing plate precursor having a crosslinked relief-forming layer.

2. The process for producing a relief printing plate precursor for laser engraving according to claim 1, wherein the resin composition for laser engraving further comprises (Component C) a compound which does not contain a siloxane bond in the molecule but has two or more active hydrogen atoms.

3. The process for producing a relief printing plate precursor for laser engraving according to claim 1, wherein the resin composition for laser engraving further comprises (Component D) a radical polymerizable compound, and (Component E) a radical polymerization initiator.

4. The process for producing a relief printing plate precursor for laser engraving according to claim 1, wherein the resin composition for laser engraving further comprises (Component F) a photothermal conversion agent capable of absorbing light having a wavelength of 700 nm to 1,300 nm.

5. The process for producing a relief printing plate precursor for laser engraving according to claim 1, wherein the resin composition for laser engraving further comprises (Component G) a plasticizer.

6. The process for producing a relief printing plate precursor for laser engraving according to claim 1, wherein the resin composition for laser engraving further comprises (Component H) a compound having a hydrolyzable silyl group and/or a silanol group.

7. The process for producing a relief printing plate precursor for laser engraving according to claim 1, wherein the average number of isocyanato groups, fn, of Component A is 2.2 to 3.8.

8. The process for producing a relief printing plate precursor for laser engraving according to claim 1, wherein Component B is a both terminal-modified silicone oil and/or a single terminal-modified silicone oil.

9. The process for producing a relief printing plate precursor for laser engraving according to claim 1, wherein Component B is selected from the group consisting of a both terminal carbinol-modified silicone oil, a both terminal amino-modified silicone oil, and a single terminal diol-modified silicone oil.

10. The process for producing a relief printing plate precursor for laser engraving according to claim 3, wherein Component D is a polyfunctional ethylenically unsaturated compound.

11. The process for producing a relief printing plate precursor for laser engraving according to claim 3, wherein Component E is an organic peroxide.

12. The process for producing a relief printing plate precursor for laser engraving according to claim 4, wherein Component F is carbon black.

13. A relief printing plate precursor for laser engraving, obtained by the process according to claim 1.

14. A process for making a relief printing plate, the process comprising:

an engraving step of laser-engraving the relief printing plate precursor according to claim 13, and thereby forming a relief layer.

* * * * *